US006109605A

United States Patent [19]

Hirota et al.

[11] Patent Number: 6,109,605

[45] Date of Patent: Aug. 29, 2000

[54] SHEET FINISHING APPARATUS

[75] Inventors: Kazuhiro Hirota; Hisao Hosoya; Satoru Endo, all of Hachioji; Yuji Kanazawa, Musashino; Takanori Yoshida, Toda; Kazuyoshi Omi, Kawagoe; Mamoru Tomotsune, Yokohama; Masanobu Kawano, Hachioji; Yukihiko Nishimoto, Akiruno, all of Japan

[73] Assignee: Konica Corporation, Tokyo, Japan

[21] Appl. No.: 09/040,584

[22] Filed: Mar. 18, 1998

[30] Foreign Application Priority Data

Mar. 24, 1997 [JP] Japan ..... 9-069405
Dec. 24, 1997 [JP] Japan ..... 9-355104

[51] Int. Cl.[7] ..... B65H 29/06

[52] U.S. Cl. ..... 271/186; 271/187; 271/270; 271/277; 271/82; 271/315

[58] Field of Search ..... 271/82, 270, 277, 271/246, 187, 315, 186, 176, 182

[56] References Cited

U.S. PATENT DOCUMENTS

| | | | |
|---|---|---|---|
| 4,736,941 | 4/1988 | Petersen | 271/82 |
| 5,026,036 | 6/1991 | Takahashi . | |
| 5,114,135 | 5/1992 | Evangelista et al. . | |
| 5,261,655 | 11/1993 | Keller et al. . | |
| 5,452,886 | 9/1995 | Cote et al. | 271/82 |
| 5,692,740 | 12/1997 | Holtje . | |

FOREIGN PATENT DOCUMENTS

| | | |
|---|---|---|
| 3-267260 | 11/1991 | Japan . |
| 5-750 | 1/1993 | Japan . |
| 5-70018 | 3/1993 | Japan . |
| 5-53252 | 2/1996 | Japan . |
| 5-85662 | 4/1996 | Japan . |
| 8-85663 | 4/1996 | Japan . |

*Primary Examiner*—Christopher P. Ellis
*Assistant Examiner*—Mark A. Deuble
*Attorney, Agent, or Firm*—Frishauf, Holtz, Goodman, Langer & Chick, P.C.

[57] ABSTRACT

In an sheet finishing apparatus for receiving a sheet on which an image has been formed by an image forming apparatus, and for ejecting the sheet after a front side thereof is reversed, the sheet finishing apparatus includes: a sheet conveyor for conveying the sheet fed from the image forming apparatus downstream; a sheet reversing device for receiving the sheet conveyed by the sheet conveyor, and for reversing the front side of the sheet by rotation; a sheet holder provided on a peripheral portion of the sheet reversing device for holding a leading edge portion of the sheet conveyed by the sheet conveyor, the sheet holder capable of being opened or closed; a sheet stopper for blocking the leading edge portion of the sheet to be stopped at a position where the front side of the sheet is reversed by a rotation of the sheet reversing device; and a sheet stacking member for stacking the sheet separated from the sheet reversing device by a further rotation of the reversing device after the leading edge of the sheet is blocked by the sheet stopper.

53 Claims, 18 Drawing Sheets

SHEET FINISHING APPARATUS

BACKGROUND OF THE INVENTION

The present invention relates to a sheet finishing apparatus which receives sheets delivered from an image forming apparatus or the like, and reverses the sheets by a reversing means.

Conventionally, in the case where a sheet (hereinafter, also called a recording sheet) on which an image has been formed by an image forming apparatus such as a copier, printer, or the like, is successively delivered and stacked with an image facing upward, initially the first page sheet is delivered when an original is recorded from the first page, and the sheets are successively delivered in page order, and therefore the second page recording sheet is delivered on the first page recording sheet. Accordingly, the page order of the recording sheets is disordered, and it takes a long time to finish the sheets so that the sheets are aligned in page order. Accordingly, a recording sheet reversing device is provided by which the sheets are successively delivered with the image facing downward and aligned in page order, by reversing the recording sheet delivered from the image forming apparatus by a reversing means.

As the recording sheet reversing device, Japanese Patent Publication Open to Public Inspection Nos. 267260/1991, 750/1993, 70018/1993, 53252/1996, 85662/1996, 85663/1996, etc., are disclosed.

A guide slot is provided to insert the leading edge of the recording sheet, conveyed by a conveying roller after the recording sheet has been delivered from the image forming apparatus, into a drum-like formed recording sheet reversing means, and the recording sheet reversing means is reversed after the leading edge of the delivered recording sheet has been inserted into the guide slot.

For example, Japanese Patent Publication Open to Public Inspection No. 267260/1991 is structured such that a guide slot is formed on a reversing disk body; the recording sheet is conveyed by a conveying roller pair; and the leading edge of the recording sheet is inserted into the guide slot. When the recording sheet is inserted, the reversing disk body is stopped, however, when the leading edge of the recording sheet is inserted into the narrow guide slot, it can not be smoothly inserted if the leading edge of the recording sheet has any curve or bend.

The guide slot is formed into a long curve along the reversing disk body. In a thin recording sheet, there is a case where, because it has a smaller stiffness, it is bent on the way, and can not be inserted to a predetermined depth. In this case, because the recording sheet is held by the guide slot, the recording sheet is dropped out of the guide slot when the reversing disk body is reversed, and a recording sheet reversing operation can not be smoothly carried out. Specifically, when the reversing operation is carried out at a higher speed, a provability becomes higher in which the recording sheet is dropped out of the guide slot, and the reversing operation can not efficiently be carried out. Reversely, in the case of the thick recording sheet with high stiffness, there is a problem in which it can hardly be inserted into the guide slot.

Further, Japanese Patent Publication Open to Public Inspection No. 53252/1996 is structured such that a long receiving slot is provided to insert the recording sheet into a disk unit which is reversing-operated; and the leading edge of the recording sheet is inserted into the disk unit and the sheet is reversely conveyed. Next, when the disk unit is rotated and a reciprocating boss member is moved to a lower position, it is dropped downward by gravity, and presses the recording sheet in the receiving slot. In this structure also, because the leading edge of the recording sheet is inserted into the long receiving slot, in also the case of the thin recording sheet, in the same manner as described above, the sheet is bent on the way due to the lower stiffness of the recording sheet, or reversely, in the case of the thick recording sheet with higher stiffness, the recording sheet is hardly inserted into the guide slot, which are problems. Further, in the reciprocating boss member to hold the recording sheet in the receiving slot, the recording sheet inserted into the receiving slot of the disk unit is not held when the reciprocating boss member is not moved to the lower position, and during the reverse conveyance, the recording sheet is only inserted simply into the receiving slot, and thereby the recording sheet is easily dropped out of the receiving slot.

SUMMARY OF THE INVENTION

The present invention is specifically considered to solve the above problems. That is, the object of the present invention is to securely hold the recording sheet by the sheet reversing means and reversely convey the sheet, even when a condition of curvature or thickness of the leading edge of the recording sheet is different. Further object is to securely reverse the recording sheet even when the size of the recording sheet is different.

The object of the present invention is attained by any one of the following structures (1) to (4).

(1) A sheet finishing apparatus in which a sheet, on which an image has been formed by an image forming apparatus, is received, and is reversed and delivered, the sheet finishing apparatus has a sheet conveyance means for conveying the sheet, sent from the image forming apparatus, toward the downstream side; a rotating sheet reversing means for receiving and reversing the sheet conveyed by the sheet conveyance means; a sheet holding means, which can be opened and closed, provided on the rotating peripheral portion of the sheet reversing means so that the edge portion of the sheet, conveyed by the sheet conveyance means, is nipped and held on the sheet reversing means; a sheet stopping means for blocking the edge portion of the sheet at a position at which the sheet is reversed by the rotation of the sheet reversing means, and for stopping the sheet; and a sheet stacking member for stacking the sheet, separated from the sheet reversing means by further rotation of the sheet reversing means, after the edge portion of the sheet is blocked by the sheet stopping means.

(2) A sheet finishing apparatus in which a sheet, on which an image has been formed by an image forming apparatus, is received, and is reversed and delivered, the sheet finishing apparatus has a sheet conveyance means for conveying the sheet, sent from the image forming apparatus, toward the downstream side; a rotating sheet reversing means for receiving and reversing the sheet conveyed by the sheet conveyance means; a sheet holding means, which can be opened and closed, provided on the rotating peripheral portion of the sheet reversing means so that the edge portion of the sheet, conveyed by the sheet conveyance means, is nipped and held on the sheet reversing means; and a control means for increasing the line speed of the sheet conveyance means higher than that of the sheet reversing means, after the sheet is held on the sheet reversing means by the sheet holding means.

(3) A sheet finishing apparatus having a reversing means for receiving the conveyed sheet and reversing the sheet by the rotating movement, a conveyance means for conveying the sheet into the reversing means, a leading edge portion stopping means for stopping the leading edge portion of the reversed sheet at a predetermined position, and a stacking means for stacking the reversed sheet, the sheet finishing apparatus is characterized in that it has a driving means for rotating the reversing means at a predetermined first conveyance speed when the sheet conveyed into the reversing means is received, and after that, rotating the reversing means at the second conveyance speed higher than the first conveyance speed.

(4) A sheet finishing apparatus having a reversing means for receiving the conveyed sheet and reversing the sheet, a conveyance means for conveying the sheet into the reversing means, a leading edge portion stopping means for stopping the leading edge portion of the reversed sheet at a predetermined position, and a stacking means for stacking the reversed sheet, the sheet finishing apparatus is characterized in that, after the leading edge portion has been conveyed while the conveyance means and the reversing means are driven at almost the same speed, the conveyance speed of the conveyance means is increased higher than that of the reversing means, thereby, the trailing edge portion of the sheet is conveyed between the reversing means and the conveyance means with the difference between their conveyance speeds, so that the sheet is separated from the reversing means at the time of reversing.

DETAILED DESCRIPTION OF THE PREFERRED EMBODIMENTS

Figure 1:
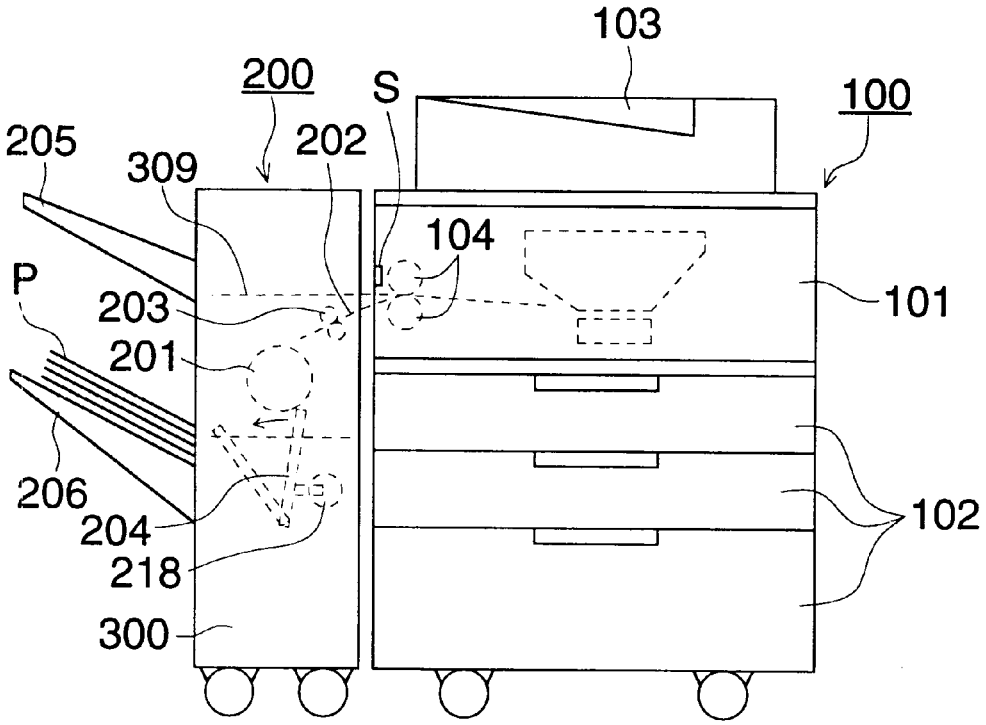
FIG. 1 is a front view in which a sheet finishing apparatus of the present invention is connected to an image forming apparatus.

FIG. 1 is a front view in which an image forming apparatus 100 such as a copier, or the like, is connected to a sheet finishing apparatus 200 of the present invention.

The image forming apparatus 100 is composed of an image forming section 101 and a plurality of sheet feeding sections 102 provided below the image forming section 101, and further, an automatic document feeding device 103 is located on the image forming section 101. A recording sheet P is fed from the sheet feeding section at the same time when the document is sent from the automatic document feeding device 103 by the start of the image forming apparatus 100, and after an image is transferred onto the fed recording sheet from the image forming section 101, the recording sheet is delivered by a pair of sheet delivery rollers 104 which deliver the fixed recording sheet P. The recording sheet P is detected by a sheet sensor S for sheet delivery at the time of sheet delivery, and it is confirmed that the recording sheet P is delivered from the image forming apparatus 100.

Next, the recording sheet P is sent to a sheet finishing apparatus 200. When the document is copied from the final page using the automatic document feeding device 103, the sheet is delivered by ordinary sheet delivery operations from a delivery sheet conveying section 309 onto a sheet delivery tray 205 provided on a frame 300.

The apparatus is structured as follows. In the case where the page order of the recording sheet P is not correct when a plurality of documents are copied from the first page, and delivered without any additional operation, the recording sheet P is fed by being switched to a conveyance section for reversing 202, conveyed by a conveying roller pair 203, which is a sheet conveyance means; next, the leading edge of the recording sheet P is held by a sheet reversing drum 201, which is a sheet reversing means, and is reversed; next, after the recording sheet P is stopped by a sheet stopping member 204, the sheet stopping member 204 is driven by a driving member 218; and the recording sheet P is delivered onto a reversed sheet delivery tray 206.

The above description is made for the overall structure in which the sheet finishing apparatus 200 is connected to the image forming apparatus 100, and the concrete structure of the sheet finishing apparatus 200 of the present invention will be described bellow.

Figure 2:
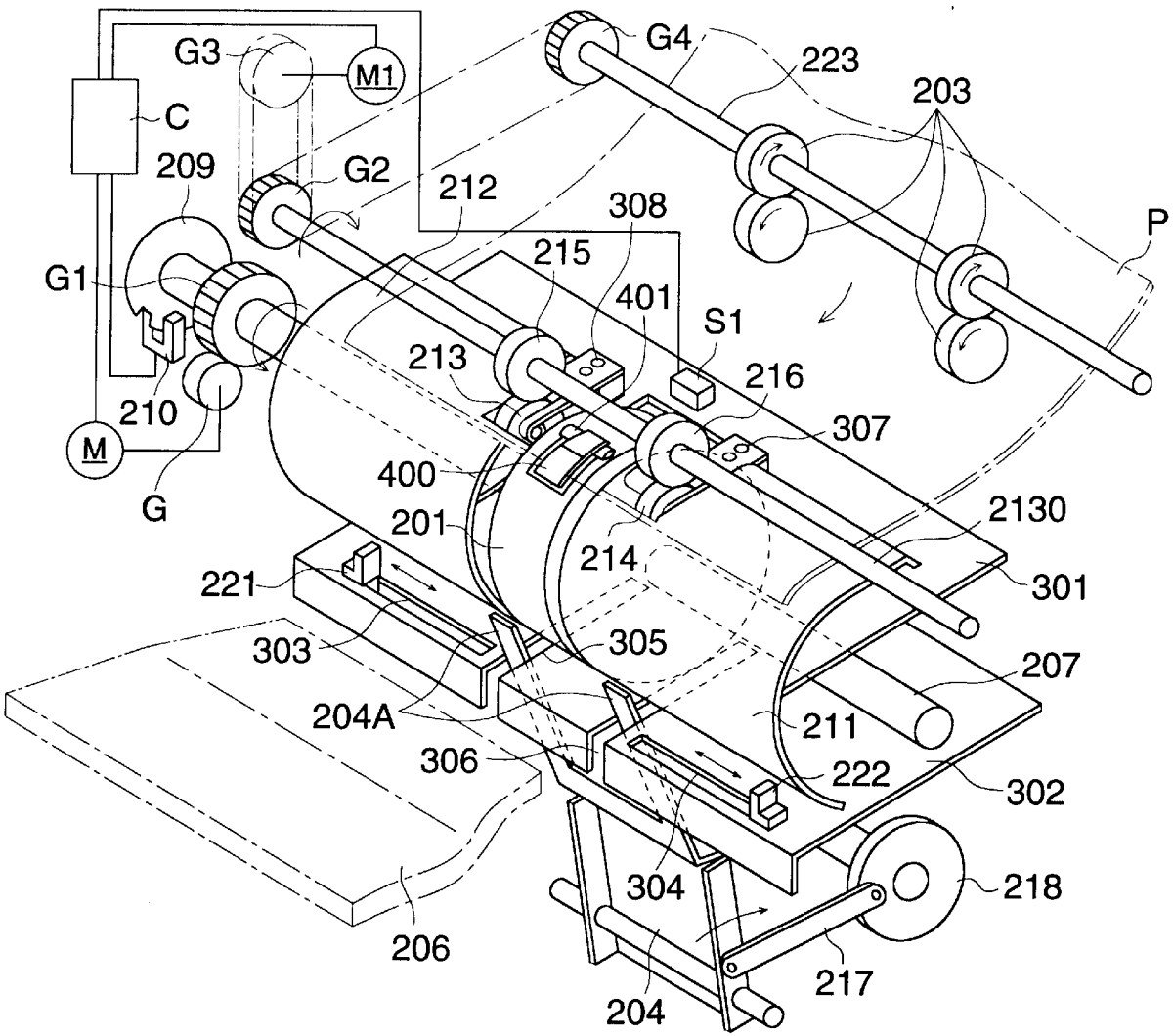
FIG. 2 is a perspective view showing an outline structure of the sheet finishing apparatus of the present invention.

FIG. 2 is a perspective view showing an outline structure of the sheet reversing drum 201 and the sheet stopping member 204 in the sheet finishing apparatus 200.

One conveying roller of the conveying roller pair 203 is fixed on a drive shaft 223, the drive shaft 223 is rotatably provided in a frame 300 in FIG. 1, and a driving gear G4 is fixed on its one end. In order to reverse the recording sheet P delivered from the image forming apparatus 100, the recording sheet P nipped by the conveying roller pair 203, is sent to the sheet reversing drum 201, which is formed into the drum-shape, with the leading edge of the recording sheet P in the lead, and is detected by a sensor S1.

The sheet reversing drum 201 is fixed on a shaft 207, the shaft 207 is rotatably provided in the frame 300 constituting the sheet reversing drum 201, a gear G1 is fixed on one end of the shaft 207, and the sheet reversing drum 201 is rotated counterclockwise through a reduction gear G driven by the driving motor M, and the shaft 207 together with the gear G1. Further, a rotating cutout plate 209 to control the rotation of the sheet reversing drum 201 is provided on the end of the shaft 207, and a sheet reversing drum sensor 210 is provided to detect the rotating cutout plate 209.

The sheet reversing drum 201 is fixed by the shaft 207 so that the drum 201 is located at almost central portion of the recording sheet P conveyed by the conveying roller pair 203. Further, in order to hold the leading edge of the conveyed recording sheet P, a sheet holding means, which can be opened and closed, is provided at a position of the peripheral portion of the sheet reversing drum 201. A movable sheet holding means 400 is rotatably provided so that it is opened in the direction of reception of the recording sheet P which is fed and conveyed, and the recording sheet P is held by the close of the movable sheet holding means 400. A fixed sheet holding member 401 fixed on the sheet reversing drum 201 is provided opposing the movable sheet holding member 400. The movable sheet holding member 400 and the fixed sheet holding member 401 are provided so that the recording sheet P is nipped and held between these members.

Further, sheet conveyance members 215 and 216 for receiving the leading edge of the recording sheet P sent by the conveying roller pair 203, are fixedly provided on a shaft 2130 close to both sides in the direction of the rotating shaft of the sheet reversing drum 201, at a position above the shaft 207 of the sheet reversing drum 201. A driving gear G3 driven by a conveying motor M1 is provided being interlocked with a gear G2 provided on one end of the shaft 213 in order to drive the gear G2, so that the sheet conveyance members 215 and 216 are rotated clockwise. Further, a pair of driven rollers 213 and 214 which contact with the sheet conveyance members 215 and 216, are provided through spring members 307 and 308, which are respectively fixed on a supporting plate 301 provided in the frame 300. Like this, the sheet conveyance member 215 and the driven roller 213, and the sheet conveyance member 216 and the driven roller 214 are respectively paired with each other, and are provided close to both sides of the sheet reversing drum 201 as described above.

The recording sheet P is nipped by the movable sheet holding member 400 and the fixed sheet holding member 401, the sheet reversing drum 201 is rotated, and sheet guiding members 211 and 212 to simultaneously guide both sides of the recording sheet P when the drum 201 is reversed, are formed along the peripheral portion in the rotational direction of circumference of the sheet reversing drum 201, and are fixed on the supporting plate 301.

When the sheet reversing drum 201 is rotated with the shaft 207 counterclockwise and the recording sheet P is reverse-conveyed, the recording sheet P is guided onto the sheet stacking member 302 provided in the frame 300 under the condition that the recording sheet P is reversed. Open grooves 305 and 306 are formed on the sheet stacking member 302 on which the recording sheet P is stacked, and a sheet blocking member 204A formed of 2 members, integrated with the sheet stopping member 204, which is a sheet stopping means, is protruded from the open grooves 305 and 306. Further, the sheet stopping member 204 is moved through a connecting rod 217, a crank 218 is rotated by the driving means, and the sheet blocking member 204A is stopped at a predetermined position of the sheet stacking member 302.

The recording sheet P is reverse-conveyed under this condition, and the leading edge of the recording sheet P is blocked by the sheet blocking member 204. On the other hand, because thee sheet reversing drum 201 is continuously rotated, the recording sheet P, under a nipped condition, is separated from the movable sheet holding member 400 and the fixed sheet holding member 401. The recording sheet P is stopped under a stacked condition at a position at which the sheet blocking member 204A is stopped on the sheet stacking member 302. After reverse-conveyance of a plurality of recording sheets P has been completed, finishing processing such as stapling or the like is conducted as necessary, and the sheet blocking member 204A is moved in the direction of sheet delivery and the stapled recording sheets P is delivered onto the reverse sheet delivery tray 206.

In this connection, the sheet detecting member S1, driving motors M, M1, and the detecting means 210 to detect a rotating cutout plate 209, are respectively connected to a control device C and controlled. In the control device C, as shown by a control block diagram in FIG. 9, a reverse driving circuit C1 and a reverse control circuit C2 for the sheet reversing drum 201, are provided. In the reverse control circuit C2, an angular counting circuit C3 for the sheet reversing drum 201 is provided.

Numerals 221 and 222 are sheet position regulating members to determine positions for conveyance and delivery, when the recording sheet P is reverse-conveyed by the sheet reversing drum 201 or delivered from the sheet stacking member 302 onto the reverse sheet delivery tray 206, and the sheet position regulating members are moved along guiding slots 303, 304 in the direction perpendicular to the advancing direction of the recording sheet.

The structure of the sheet finishing apparatus 200 of the present invention was described by the perspective view as above, and further, the structure viewed from the side will be described below.

Figure 3:
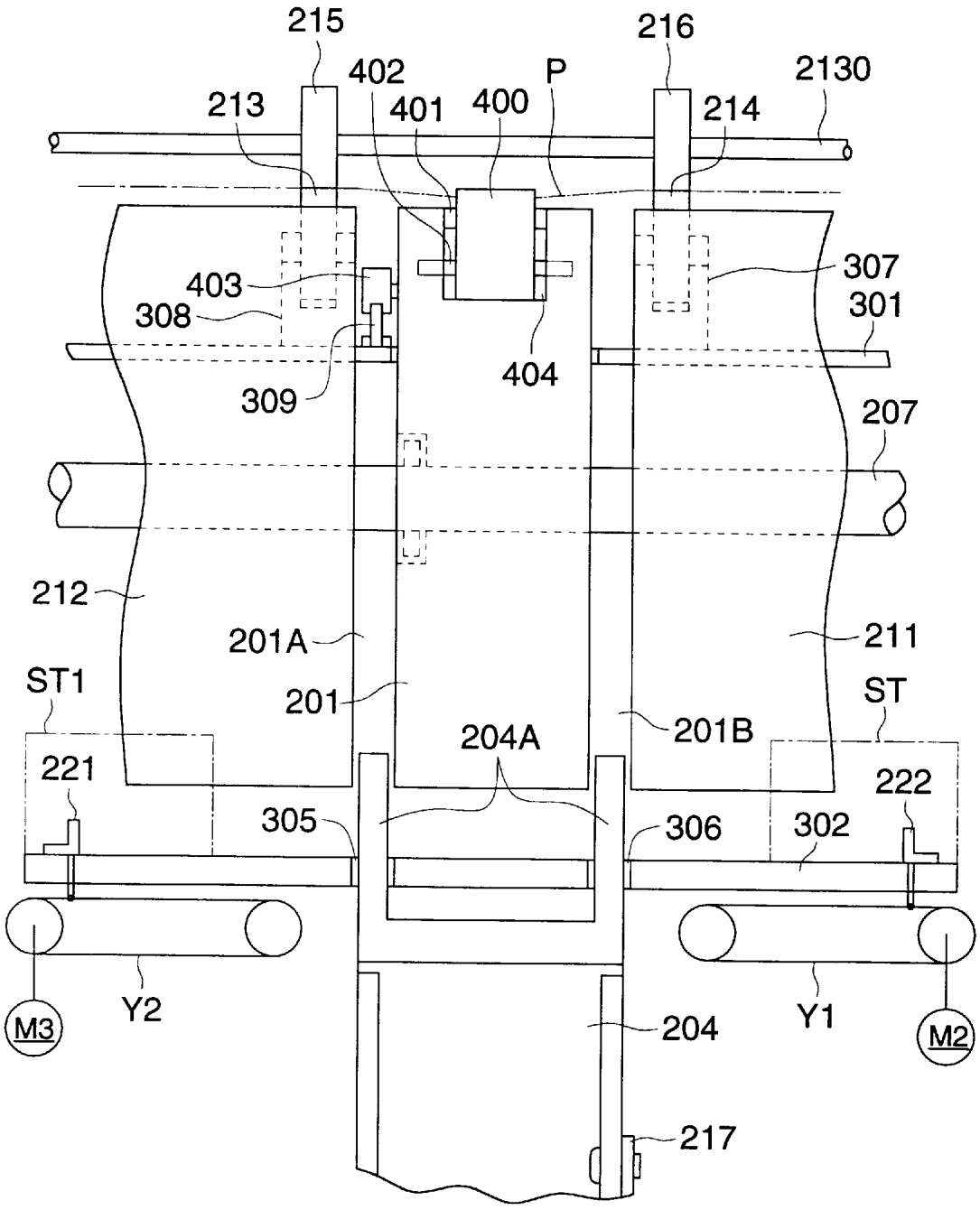
FIG. 3 is a side view of the sheet finishing apparatus of the present invention.

FIG. 3 is a side view of the sheet finishing apparatus, which shows the sheet reversing drum and the sheet stopping member.

The sheet reversing drum 201 fixed on the shaft 207 is arranged almost vertically, as shown in the drawing, and sheet guiding members 211 and 212 are fixed on the supporting plate 301 through a few amount of gaps 201A and 201B on both sides of the sheet reversing drum 201. The movable sheet holding member 400 is rotatably provided on a supporting shaft 402, in a hole 404 provided in one portion in the circumferential direction of the sheet reversing drum 201, and is opposite to a fixed sheet holding member 401 fixed on the sheet reversing drum 201. Further, a moving roller 403 is integrally provided on the movable sheet holding member 400, and comes into contact with a cam 309 provided on the supporting plate 301. This system is opened and closed on the side on which the recording sheet P is inserted, between the movable sheet holding member 400 and the fixed sheet holding member 401.

When the sheet reversing drum is rotated, the moving roller 403 of the movable sheet holding member 400 comes into contact with the cam 309, and stops and stands ready at a position at which a gap between the movable sheet holding member 400 and the fixed sheet holding member 401is opened. Two portions of the leading edge of the recording sheet P are conveyed by respectively paired sheet conveyance members 215, 216 and driven rollers 213, 215, and the central portion of the 2 portions of the leading edge is conveyed into a gap between movable sheet holding member 400 and the fixed sheet holding member 401, and advanced.

Next, when the sheet reversing drum 201 is rotated, the moving roller 403 of the movable sheet holding member 400 is separated from the cam 309 and is closed, and the central portion of the leading edge of the recording sheet P is nipped between the movable sheet holding member 400 and the fixed sheet holding member 401 for reverse-conveyance. As described in FIG. 2, the leading edge of the reverse-conveyed recording sheet P is blocked by the sheet blocking member 204A of the sheet stopping member 204, and the recording sheet P is stacked on the sheet stacking member 302.

Sheet position regulating members 221 and 222 provided on the sheet stacking member 302 are provided on wire driving means Y1 and Y2 driven by driving motors M2 and M3. When the rotation of the driving motors M2 and M3 is controlled, the sheet position regulating members 221 and 222 are moved in the direction of the width of the recording sheet P, and further, the sheet delivery position is determined.

Further, staplers ST and ST1 to conduct stapling, which is a sheet finishing process, when a plurality of recording sheets P are reverse-delivered, are provided at the position of sheet stacking member 302. Although not shown in the drawing, the staplers ST and ST1 are movable to a predetermined position corresponding to the size of the recording sheet P.

The main structure of the sheet finishing apparatus 200 of the present invention was described referring to FIGS. 2 and 3. The control and operation sequence of the recording sheet reversing operations of the sheet finishing apparatus 200 will be described below.

FIGS. 4, 5, 6, 7, and 8 are front views of the sheet reversing drum 201 which reverses the sheet P, in the sheet finishing apparatus 200 of the present invention, and are illustrations of reversing operation sequence which reverses the conveyed recording sheet P.

Figure 9:
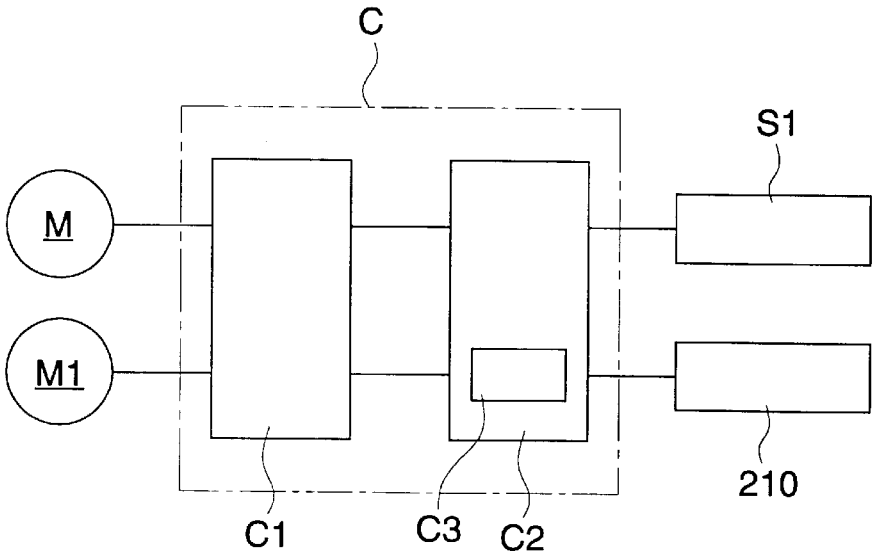
FIG. 9 is a control block diagram showing the control of the sheet finishing apparatus of the present invention.

FIG. 9 is a control block diagram to control the sheet finishing apparatus 200.

Figure 10:
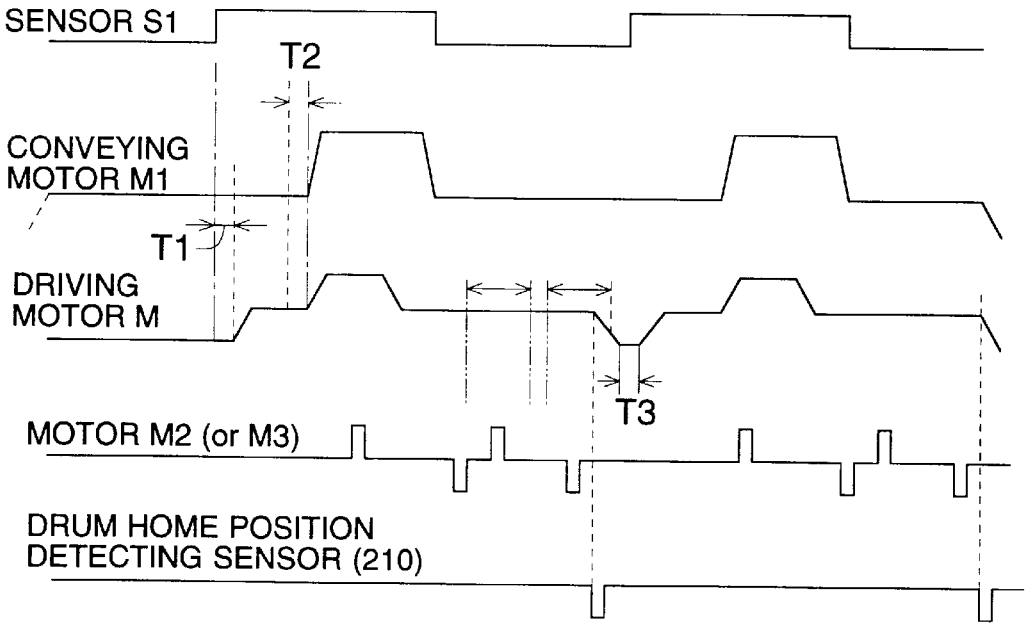
FIG. 10 is a time chart showing the control of the sheet finishing apparatus of the present invention.
Figure 11:
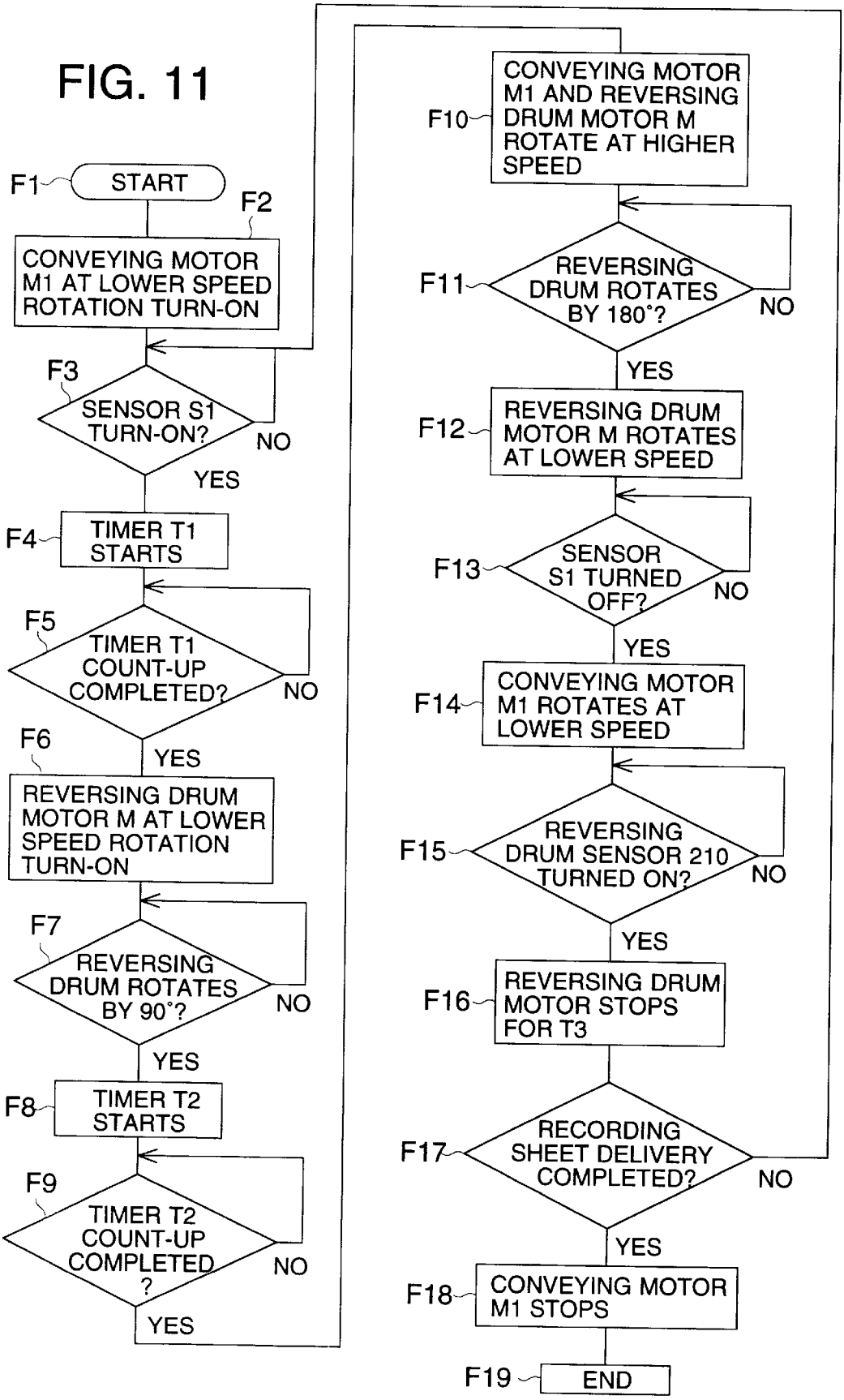
FIG. 11 is a flow chart showing the control of the sheet finishing apparatus of the present invention.

FIG. 10 is a time chart of the recording sheet reversing control sequence. FIG. 11 is a flow chart of the recording sheet reversing control sequence.

A conveying roller pair 203 is integrally provided with a reversing conveyance section 202, and is provided on the leading edge of an arm 311 provided on a shaft 313 fixed in the sheet finishing apparatus 200. The arm 311 is supported by a rotation cam 312, and the recording sheet receiving portion of the reversing conveyance section 202 is held at a sheet delivery position of the image forming apparatus 100. When recording sheet P jamming occurs in the image forming apparatus 100, or during ordinary sheet delivery, rotation cam 312 is operated, and the reversing conveyance section 202 is dropped downward together with the arm 311, and the recording sheet P is delivered onto the sheet delivery tray 205 shown in FIG. 1.

The movable sheet holding member 400 is provided such that it is always in pressure-contact with the fixed sheet holding member 401 by an elastic member SP as shown in the drawing. Further, in holes 409, 410 formed in the peripheral portion of the sheet reversing drum 201, a sheet movement member 405 is supported by each shaft 406. A sheet contacting member 407 having some elasticity is fixed on one end of the outside of the sheet movement member 405 so that it directly contacts with the recording sheet P to move the recording sheet P.

A weight 408 is provided on the inside of the other end of the sheet movement member 405, and when the sheet movement member 405 is moved to the upper position during rotation of the sheet reversing drum 201, the sheet movement member 405 is accommodated in the holes 409 and 410, together with the sheet contacting member 407 by the weight 408. As the sheet movement member is moved downward, the sheet contacting member 407 is moved from the inside of the holes 409 and 410 to the outside by the weight 408, and the leading edge of the reversed recording sheet P comes into contact with the sheet blocking member 204A, which is in a predetermined position, so that the recording sheet P is aligned.

Figure 4:
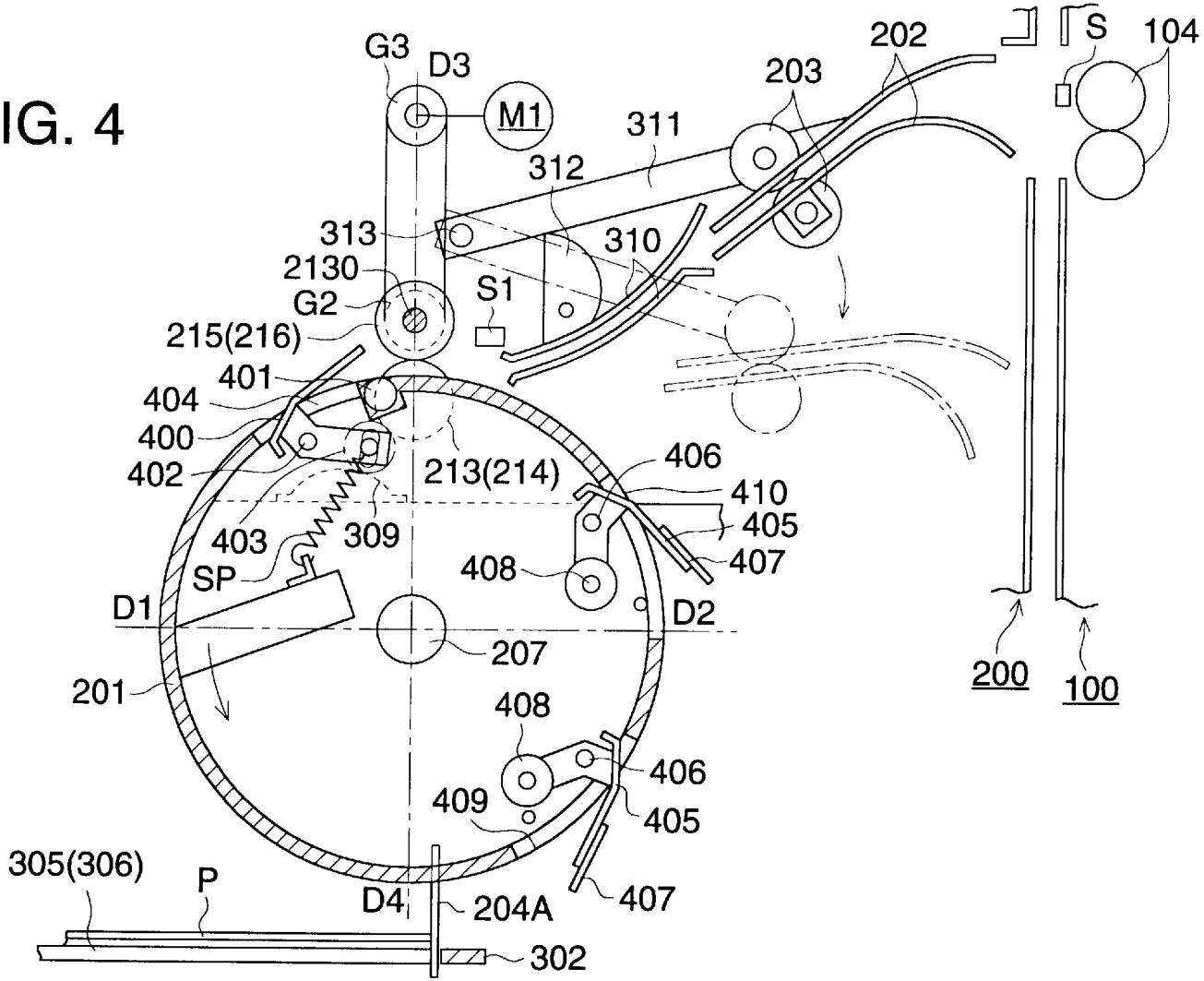
FIG. 4 is a front view showing a sheet reversing drum of the sheet finishing apparatus of the present invention.

The sheet reversing drum 201 shown in FIG. 4 is under the condition before the recording sheet P is delivered from the image forming apparatus 100, and is ready for reversing the recording sheet P to be delivered, and the sheet reversing drum 201 is stopped at this position. The movable sheet holding member 400 is stopped at the upper position of the sheet reversing drum 201, in the position at which the movable sheet holding member 400 passed the vertical line D3–D4 as shown in the drawing.

During such a ready condition, when the moving roller 403 of the movable sheet holding member 400 comes into contact with the cam 309 at the upper position of the stopped sheet reversing drum 201, the movable sheet holding member 400 is separated from the fixed sheet holding member 401 against the elastic member SP, and a gap between them is opened in the conveyance direction of the recording sheet P, so that the recording sheet P can be inserted. Next, the sheet movement member 405 which passed the a horizontal line D1–D2 and further moved to the upper position, is moved into the hole 410 by the weight 408. On the other hand, the sheet movement member 405 which is rotated from a position before the line D3–D4 at the lower position, is moved outside the hole 410 by the weight 408, and is stopped at a position at which it passed the line D3–D4 in the lower position.

Next, image processing has been completed in the image forming apparatus 100, the recording sheet P is delivered by the sheet delivery roller 104, and the recording sheet P is detected by the sheet detecting member S1, thereby, the driving control of the sheet reversing drum 201 is started.

Referring to a flow chart in FIG. 11, and a time chart in FIG. 10, the operation sequence of FIGS. 5, 6, 7, and 8 will be described below.

Figure 5:
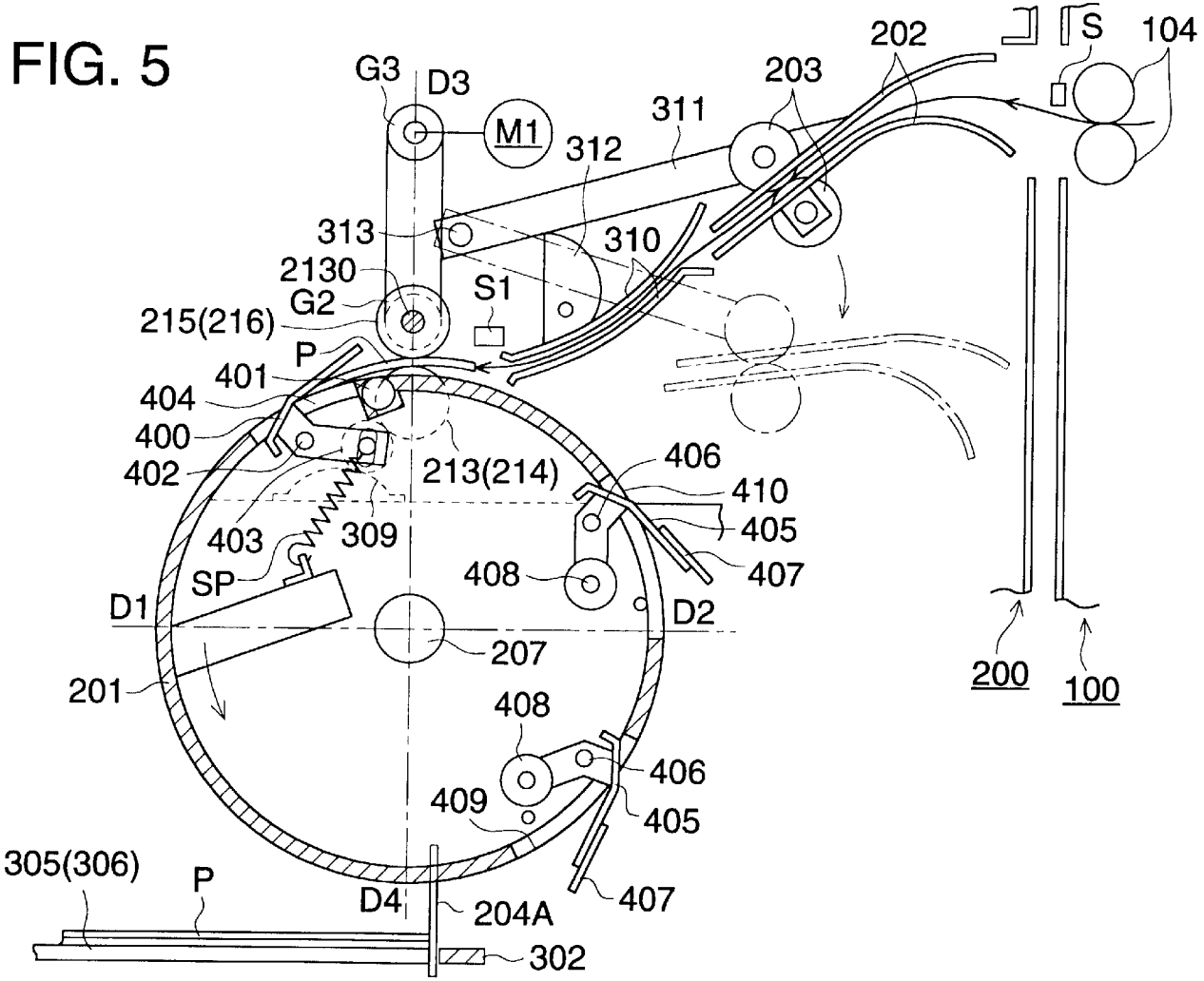
FIG. 5 is a front view showing a sheet reversing drum of the sheet finishing apparatus of the present invention.

By the start of the step F1, a power source of the conveying motor M1 is turned ON at the step F2, the drive of the conveying motor M1 is started at a low speed, and the recording sheet P is conveyed by the conveying roller pair 203 in the reverse-conveying section 202 shown in FIG. 5. Gears G2 and G4 are rotated clockwise through the driving gear G3 by the start of the drive, and paired sheet conveying members 215, 216 and driven rollers 213 and 214 are rotated at a low speed in the direction of conveyance of the recording sheet P. When the recording sheet P is conveyed by the conveying roller pair 203 in the direction of the sheet reversing drum 201, the recording sheet P is detected by the sheet sensor S1, and it is judged at the step F3 whether the sheet sensor S1 is ON.

In the case where the sheet sensor S1 is judged to be ON when the recording sheet P is conveyed, a timer T1 starts at the step F4, and after the timer T1 is operated as shown in the time chart in FIG. 10, it is judged at the step F5 whether the timer T1 has counted up.

At that time, as shown in FIGS. 4 and 5, the movable sheet holding member 400, provided on the sheet reversing drum 201, is separated from the fixed sheet holding member 401 by the action of the cam 309, and stopped under the condition that the leading edge of the recording sheet P enters these members. When it is judged that the timer T1 has counted up, the driving motor M of the sheet reversing drum 201 is turned ON at the step F6, and the sheet reversing drum 201 is rotated at a low speed, as shown by the time chart.

In this case, the conveyance speed (210 mm/sec) of the recording sheet P by the sheet conveying members 215 and 216 and the driven rollers 213 and 214, coincides with the rotational peripheral speed of the sheet reversing drum 201.

Figure 6:
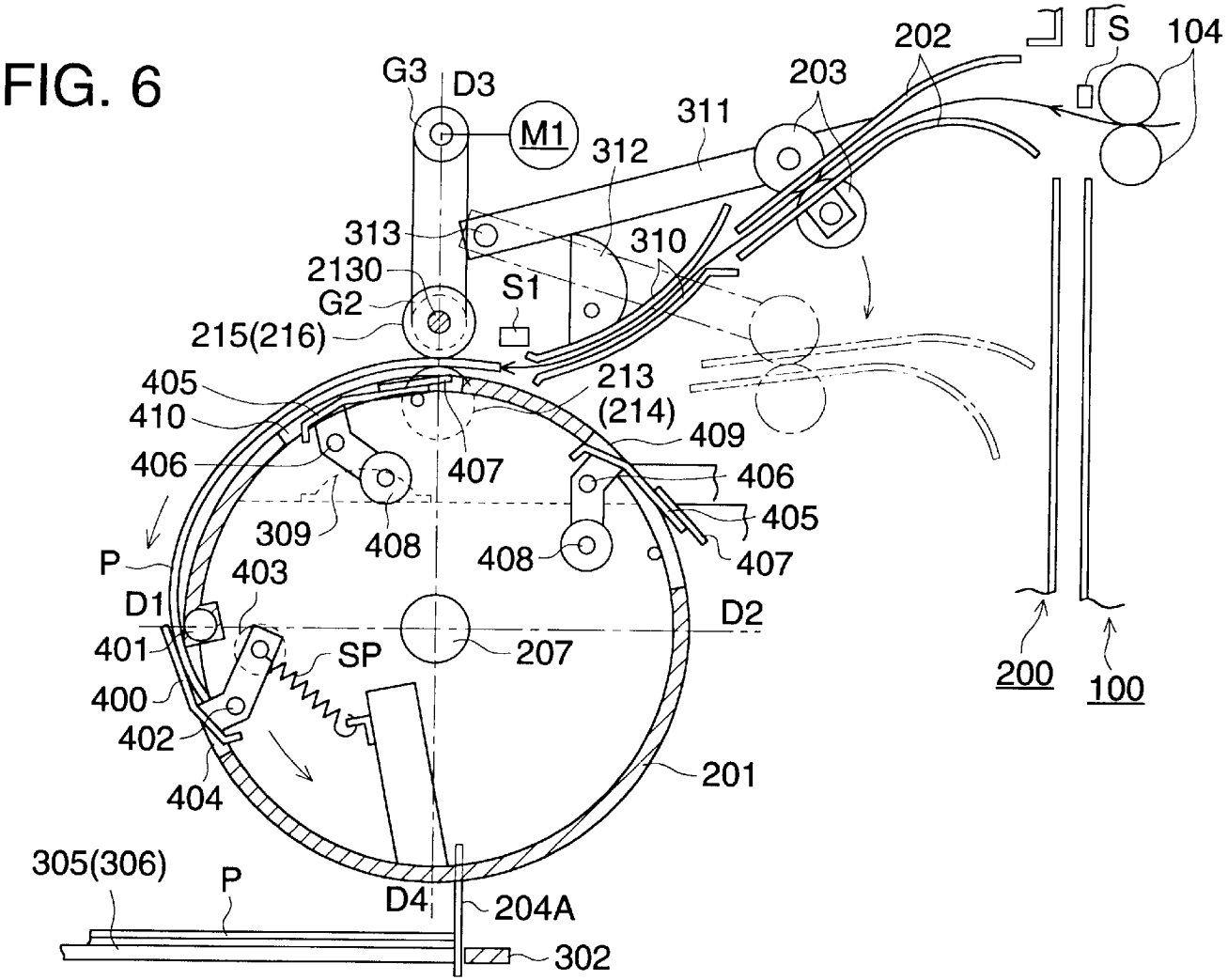
FIG. 6 is a front view showing an operation sequence of a sheet reversing drum of the sheet finishing apparatus of the present invention.

Next, as shown in FIG. 6, by the rotational movement of the sheet reversing drum 201, the operation roller 403 of the sheet holding member 400 is separated from the cam 309, the movable sheet holding member 400 is closed by the elastic member SP, and the leading edge of the recording sheet P is held between the movable sheet holding member 400 and the fixed sheet holding member 401.

As described above, the sheet reversing drum 201 is rotated from the position of line D3–D4, which is the initial starting position, to the position of line D1–D2, together with the movable sheet holding member 400. At the step F7, the rotational angle of the sheet reversing drum 201 is counted by an angle counting circuit C3 shown in FIG. 9, and it is judged whether the sheet reversing drum 201 is rotated to the first rotational angle of 90°.

When it is judged at the step F7 whether the sheet reversing drum 201 is rotated by the first rotational angle of 90°, a timer T2 starts at the step F8. As shown by the time chart, after the timer T2 is operated, it is judged at the step F9 whether the timer T2 has counted up.

When it is judged at the step F9 that the timer T2 has counted up, the speed of the conveying motor M1 of the sheet conveying member 215 and the driving motor M of the sheet reversing drum 201 are increased and are switched to high speed rotation at F10. As shown by the time chart, the recording sheet P is conveyed by the sheet conveying member 215 under the condition that the conveying motor M1 and driving motor M are rotated at a high speed, and the sheet reversing drum 201 conducts the reversing operation at a high speed. At this case, the conveyance speed of the sheet conveying members 215 and 216 is 630 mm/sec, and the peripheral speed of the sheet reversing drum 201 is also 630 mm/sec.

Figure 7:
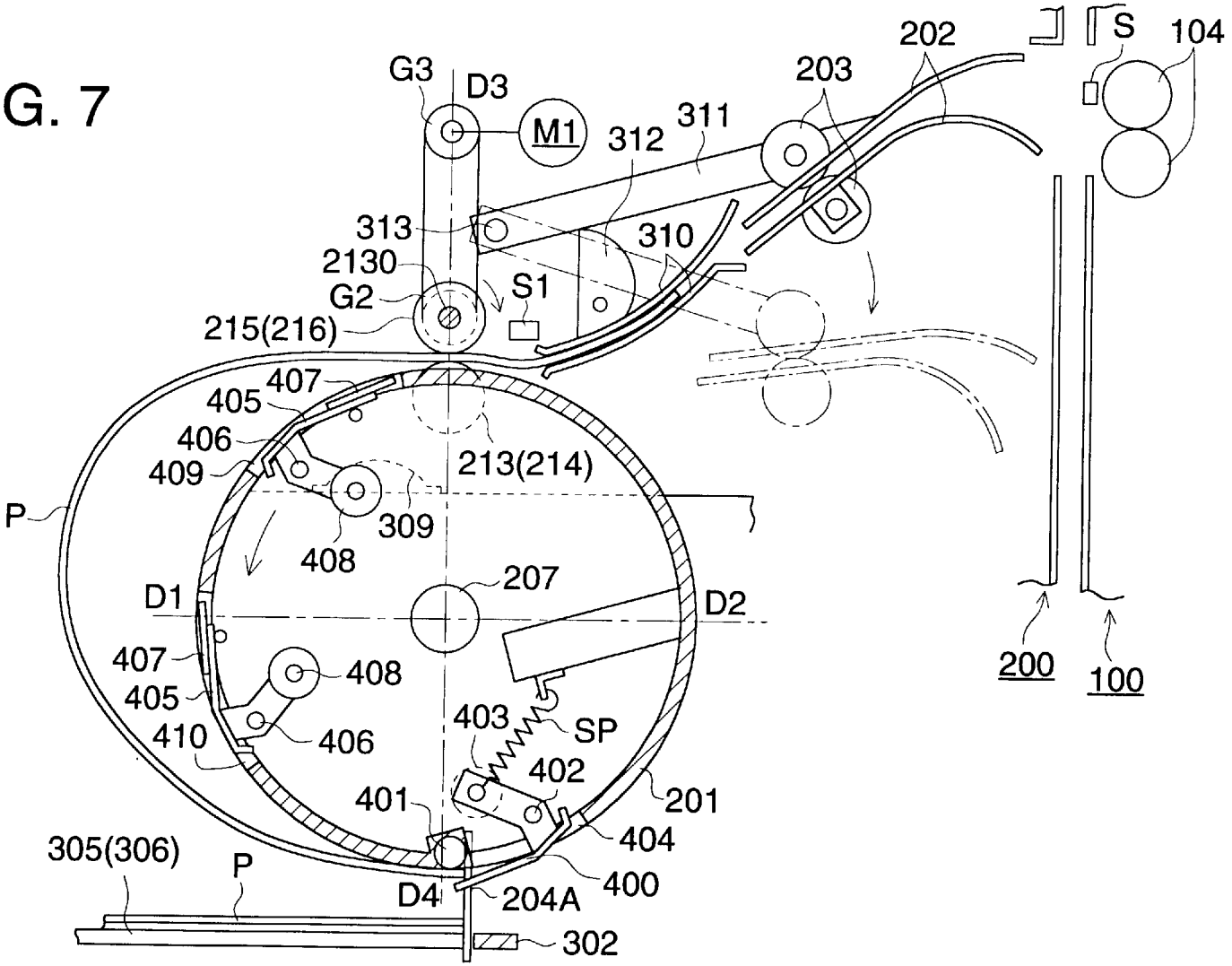
FIG. 7 is a front view showing the next operation sequence of a sheet reversing drum of the sheet finishing apparatus of the present invention.

In this stage, it is judged at the step F11 whether the sheet reversing drum 201 is rotated with the movable sheet holding member 400 from the line D3–D4 position, which is the initial starting position, by 180°, and the movable sheet holding member 400 is rotated to a position lower than the line D3–D4, as shown in FIG. 7.

When the rotation angle of the sheet reversing drum 201 is counted by the angular counting circuit C3 shown in FIG. 9, and it is judged at the step F11 that the sheet reversing drum 201 is rotated to the second rotation angle of 180°, the speed of only the driving motor M of the sheet reversing drum 201 is reduced as shown by the time chart at the step F12. Accordingly, the speed of the sheet reversing drum 201 is reduced to the line speed of 210 mm/sec, which is a lower speed, and the conveyance speed of the held recording speed P is also reduced.

However, as shown by the time chart, the speed of the conveying motor M1 of the sheet conveying members 125 and 126 is not reduced, but the high speed rotation of the increased line speed of 630 mm/sec is continued, and the recording sheet P is conveyed by the sheet conveying members 125 and 126 at the higher speed. Accordingly, as shown in FIG. 7, the trailing edge portion of the recording sheet P is separated from the sheet reversing drum 201 surface, and is continuously conveyed being curved toward the side, and it is judged at the step F13 whether the trailing edge of the recording sheet P passes the sheet sensor S1.

When it is confirmed that the trailing edge of the recording sheet P passes the sheet sensor S1 and the sheet sensor S1 is turned OFF, the speed of the conveying motor M1 of the sheet conveying members 125 and 126 return to the initial low speed rotation at the step F14, and the sheet conveying members 125 and 126 is also rotated at the lower speed. Thus, the recording sheet P is reversed by the sheet reversing drum 201 and the sheet conveying members 125 and 126, the recording surface of the recording sheet P faces downward, and one or a plurality of recording sheets P are sequentially reversed and stacked in page order.

Figure 8:
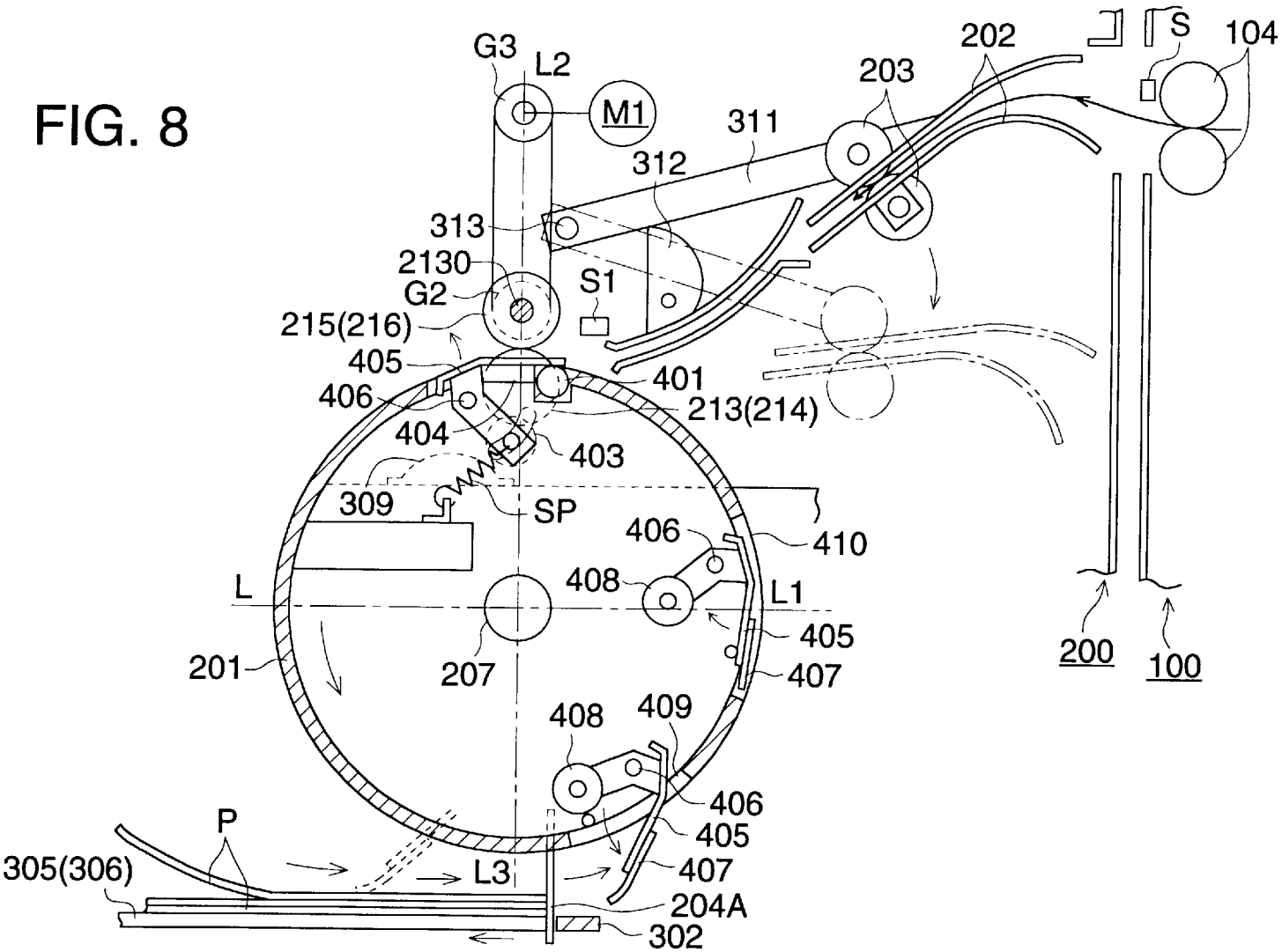
FIG. 8 is a front view showing the next operation sequence of a sheet reversing drum of the sheet finishing apparatus of the present invention.

In this case, as shown in FIG. 8, the sheet stopping member 204 is moved to a stopping position of the recording sheet P by the crank 218, shown in FIG. 2, through the connecting rod 217, and the sheet blocking member 204A is stopped at a predetermined position in the open grooves 305 and 306. The sheet reversing drum 201, whose rotation speed returns to a lower speed, is continuously rotated, thereby, the leading edge of the recording sheet P comes into contact with the sheet blocking member 204A at a low speed, and only the recording sheet P slips from the movable sheet holding member 400 which moves integrally with the sheet reversing drum 201, and the fixed sheet holding member 401, and stops at the sheet blocking member 204A position, thereby, the reversed recording sheet P is tacked on the sheet stacking member 302.

In this connection, the movable sheet holding member 400 is structured such that the recording sheet P is held between the movable sheet holding member 400 and the fixed sheet holding member 401 by the elastic member SP, however, when the leading edge of the recording sheet P comes into contact with the sheet blocking member 204A and is blocked, the recording sheet P is held by the elastic pressure whose strength level is so appropriate that the recording sheet P is smoothly pulled out from the holding condition.

Next, the leading edge of the sheet contacting member 407 of a plurality of sheet movement members 405, provided on the sheet reversing drum 201, is moved in the direction of the sheet blocking member 204A by the rotation of the sheet reversing drum 201, and the sheet contacting member 407 drops from the holes 409 and 410 by the weight 408. When the leading edge of the sheet contacting member 407 is comes into light contact with the recording sheet P surface, the leading edge of the recording sheet P is moved in the direction of the sheet blocking member 204A, and the leading edge of the recording sheet P securely comes into contact with the sheet blocking member 204A, thereby, the piled up recording sheets P are aligned. Passage of the sheet contacting member 407 through the recording sheet P surface, is made between two dotted lines shown in the driving motor M of the time chart in FIG. 10.

The sheet reversing drum 201 is rotated and the rotating cutout plate 209 provided on the shaft of the sheet reversing drum 201 is rotated a single turn, and it is judged at the step F15 whether the sheet reversing drum sensor 210 is ON. When it is judged that the sheet reversing drum sensor 210 is ON, the driving motor M of the sheet reversing drum 201 is stopped at the step F16, and T3 shown in the time chart is a stopping time of the sheet reversing drum 201.

Next, at the step F17, it is judged whether the recording sheet P is delivered from the image forming apparatus 100 to the sheet finishing apparatus 200. When the recording sheet P is not detected by the sheet sensor S of the image forming apparatus 100, and it is judged at the step F17 the sheet delivery of the recording sheet P has been completed, the conveying motor M1 stops, thereby, the sheet conveying members 215 and 216 is stopped, at the step F18, and operations of the sheet finishing apparatus are completed at the step F19.

Next, the recording sheet P is delivered in succession from the image forming apparatus 100 to the sheet finishing apparatus 200, the step F17 is NO, and the sequence returns to the step F3 in the flow chart, the recording sheet P is detected by the sheet sensor S1, and the recording sheet P is reversed.

Before the recording sheet P is reverse-conveyed to the position of sheet position regulating members 221 and 222, the sheet position regulating members 221 and 222 shown in FIG. 3 are moved to the position outside the size position of the recording sheet P through wire driving means Y1 and Y2, by the drive of the driving motors M2 and M3. In the description of this drive, the driving time of only the driving motor M2 (single side) is shown in the time chart.

Next, after the leading edge of the recording sheet P has passed through the position of sheet position regulating members 221 and 222, the sheet position regulating members 221 and 222 are moved to the inside direction of the recording sheet P, and the reversing position of the recording sheet P is regulated. Further, after the recording sheet P has been released once, the sheet position regulating members 221 and 222 are stopped, and a plurality of recording sheets P are aligned at the accurate reversing sheet delivery position on the sheet stacking member 302.

According to the present invention, the edge portion of the conveyed sheet is held by the sheet holding means, which can be opened and closed, provided on the rotational peripheral portion of the sheet reversing means, and when the sheet reversing means is rotated, the sheet is stopped by the sheet stopping means at the position at which the sheet is reversed. Accordingly, the edge portion of the sheet is securely held by the sheet holding means, and the sheet is separated at the accurate position by the sheet stopping means, thereby, the sheet reversing operation can be quickly and smoothly carried out.

According to the present invention, the edge portion of the conveyed sheet is held by the sheet holding means, which can be opened and closed, and which is provided on the rotational peripheral portion, and the sheet is stopped by the sheet stopping means at the position at which the sheet is reversed by the rotation of the sheet reversing means. Accordingly, the edge portion of the sheet is securely held by the sheet holding means, and the control means, by which the line speed of the sheet conveying means is increased more than that of the sheet reversing means, is provided so that reversing operation is controlled. Thereby, the sheet is quickly reversed, and is separated at an accurate position by the sheet stopping means, so that the sheet reversing operation can be quickly and smoothly carried out.

Different points of a sheet finishing apparatus of another example of the present invention will be mainly described below. The same numbered components as the preceding example have the same functions.

Figure 12:
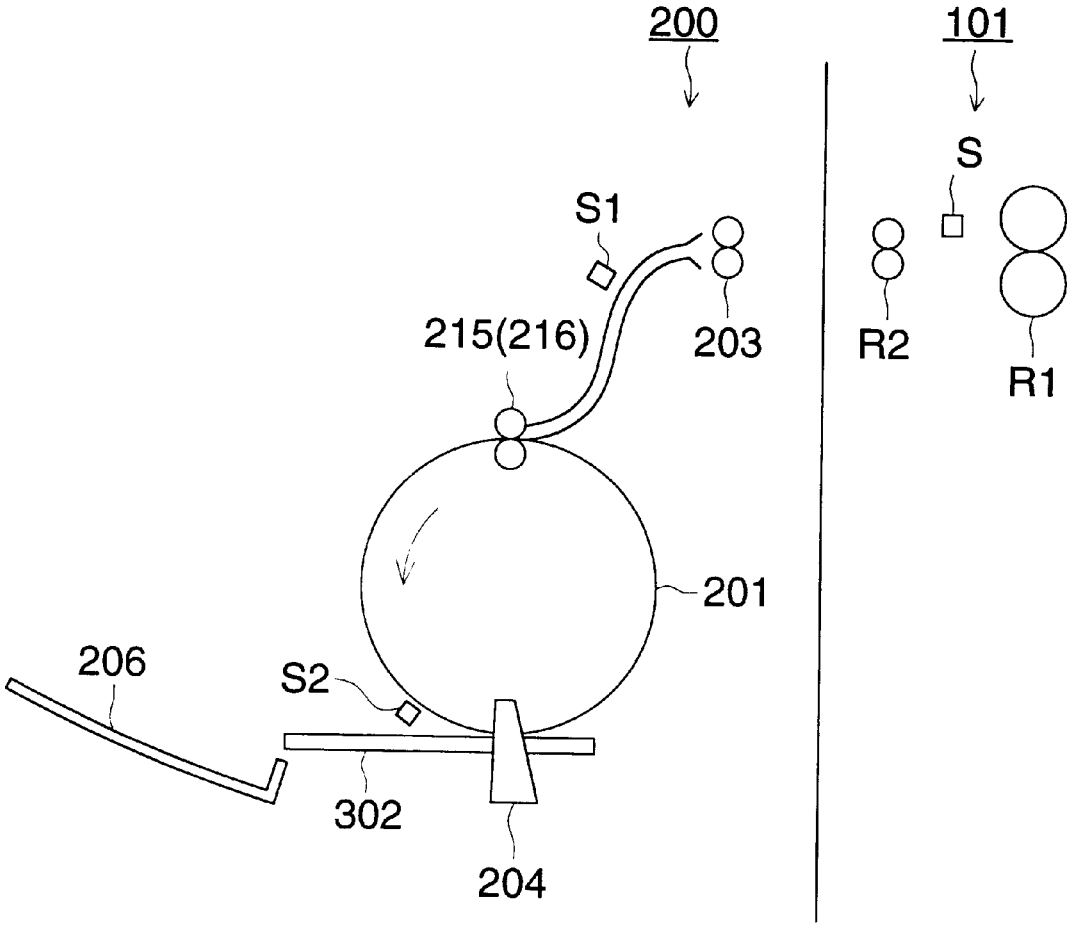
FIG. 12 is a view showing the sheet conveyance path from an image forming section to a reverse sheet delivery tray.

FIG. 12 shows the outline of the sheet conveyance path from an image forming section 101 to a reversed sheet delivery tray 206. The sheet P delivered from the image forming section 101 through a fixing roller 203 and a delivery sheet roller R2 of the image forming section 101, is supplied to the reversing drum 201 through conveying rollers 203, 215 and 216. The sheet P reversed by the reversing drum 201 is stacked on a stacking table 302, and is delivered onto the reversed sheet delivery tray 206 by the sheet delivery member 204. As the sheet sensor for the control in the sheet reverse conveyance, a sensor S provided in the sheet delivery section of the image forming section 101, a sensor S1 provided in the sheet conveying entrance of the sheet finishing apparatus 200, and a sensor S2 to detect the rotation of the reversing drum 201, the sensor S2 being provided at a position of 155° from an apex of the reversing drum 201, are used.

Further, in the same manner as the above described example, openings 303 and 304 which are perpendicular to the sheet conveying direction, are provided in the stacking table 302. Position regulating members 221 and 222 to set a sheet travelling position, that is, a position in the direction of width of the conveyance path, are protruded from these openings 303 and 304, and regulate the side position of the sheet P. As shown in FIG. 3, the position regulating members 221 and 222 are fixed on wires Y1 and Y2, driven by motors M2 and M3, and are driven by the motors M2 and M3, and respectively moved in the openings 303 and 304.

Figure 13:
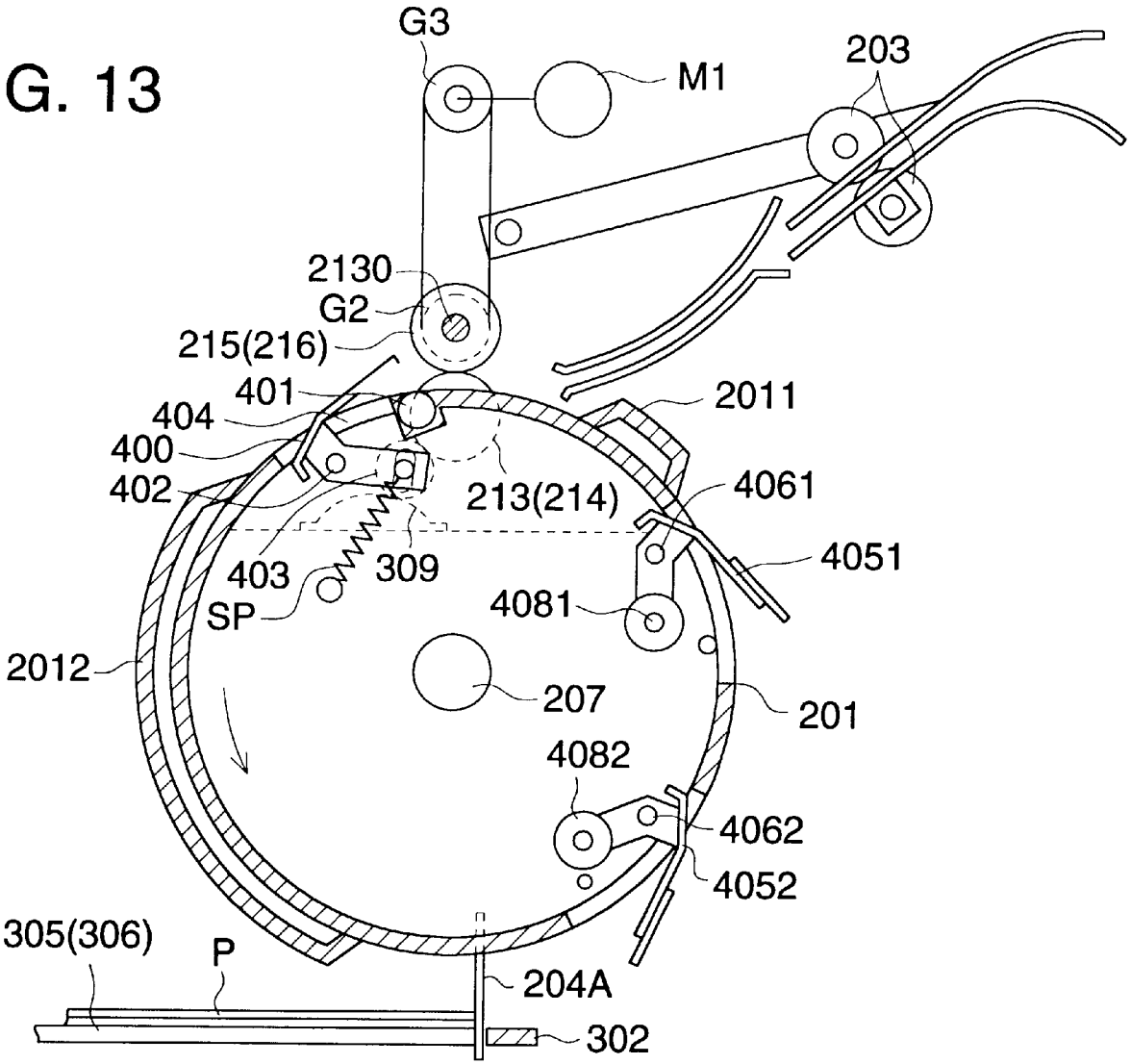
FIG. 13 is a sectional view under the sheet receiving condition of the sheet finishing apparatus shown in FIG. 12.
Figure 14:
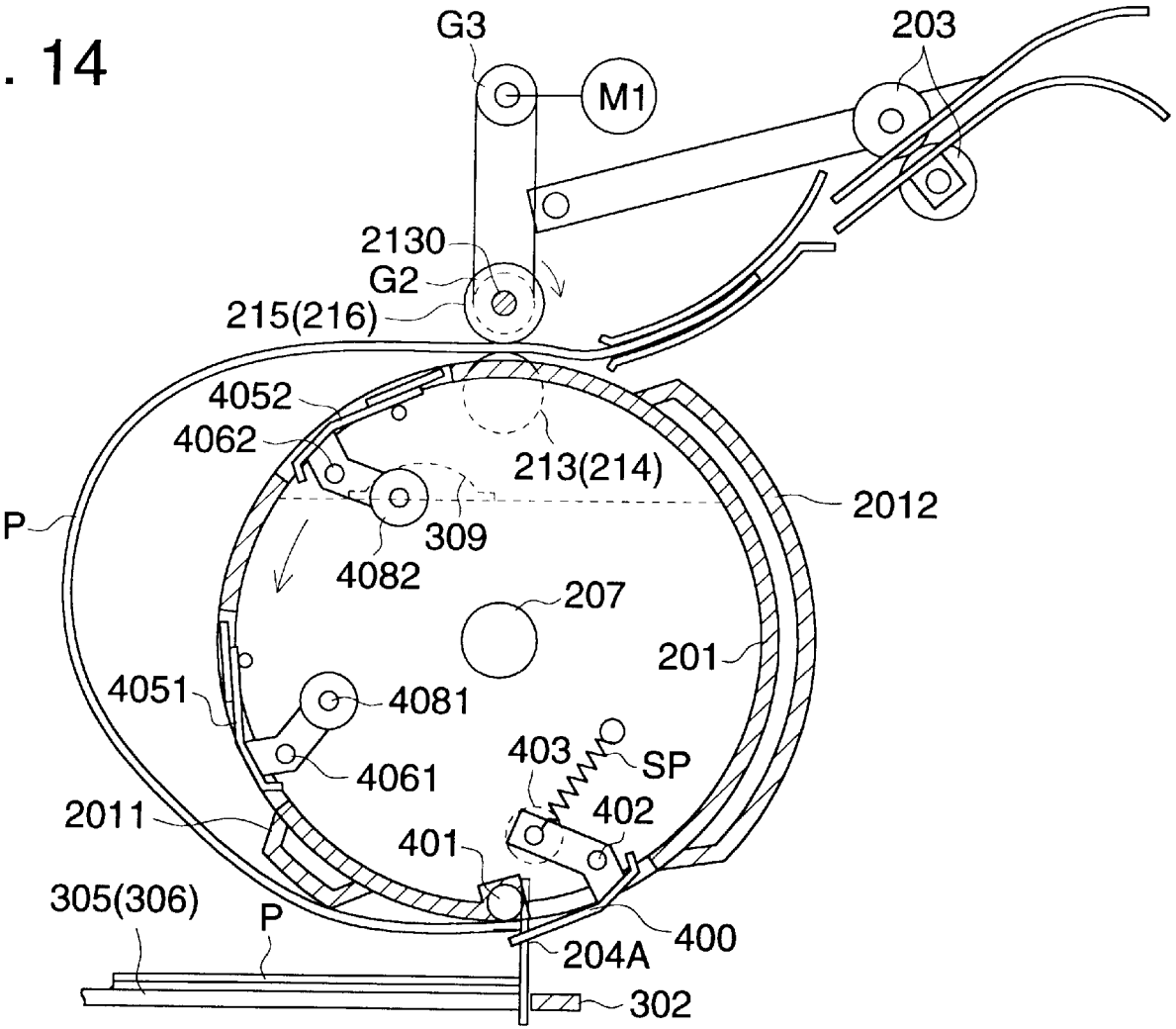
FIG. 14 is a sectional view under the sheet reversing condition of the sheet finishing apparatus shown in FIG. 12.

Referring to FIGS. 13 and 14, which are sectional views, the structure of the sheet finishing apparatus 200 will be described below.

Guiding plates 211 and 212 are provided on both sides of the reversing drum 201 with some gaps 201A and 201B between them. The cam 309 is fixed on the fixed supporting plate 301 in the gap 201A, and the operation roller 403 of the movable holding member 400 comes into contact with the cam 309. The movable holding member 400 can be rotated around the shaft 402, and is pushed by the spring SP clockwise in FIG. 13. When the movable holding member 400 stands at a position shown in FIG. 13, the operation roller 403 runs on the cam 309, and stands at a position rotated counterclockwise against the pushing force of the spring SP, and the movable holding member 400 protrudes from the peripheral surface of the reversing drum 201. When the reversing drum 201 is rotated counterclockwise from a position shown in FIG. 13, and the operation roller 403 is separated from the cam 309, the movable holding member 400 is rotated clockwise by the pushing force of the spring SP, pressure-contacts with the fixed holding member 401, and can hold the leading edge of the sheet P.

When the reversing drum 201 is further rotated, and the leading edge of the sheet P reaches the lowermost position as shown in FIG. 14, travelling of the leading edge of the sheet P is blocked by a stopping arm 204A. The reversing drum 201 is continuously rotated, receives the succeeding sheet P conveyed by the conveying roller 203, and the sheet P is reversed and successively stacked on the stacking table 302.

In the same manner as the above-described example shown in FIG. 3, the staplers ST and ST1 are provided on both sides in the direction of width of the sheet conveyance path, and are driven by a motor, not shown, and is moved corresponding to the size of the sheet. Stacked sheets P are stapled by staplers ST and ST1.

Delivery means 204 reciprocates in cutouts 305 and 306 provided in the stacking table 302 by the clank 218 rotated by a motor, not shown, and delivers the stacked and stapled sheets P on the stacking table 302 in the left direction shown in FIGS. 13 and 14. Delivered sheets P are collected on the reverse sheet delivery tray 206. Other than staplers, other finishing devices, for example, a punch to punch a specific position of the sheet, or stapling device other than the stapler, etc., may also be provided.

Figure 15:
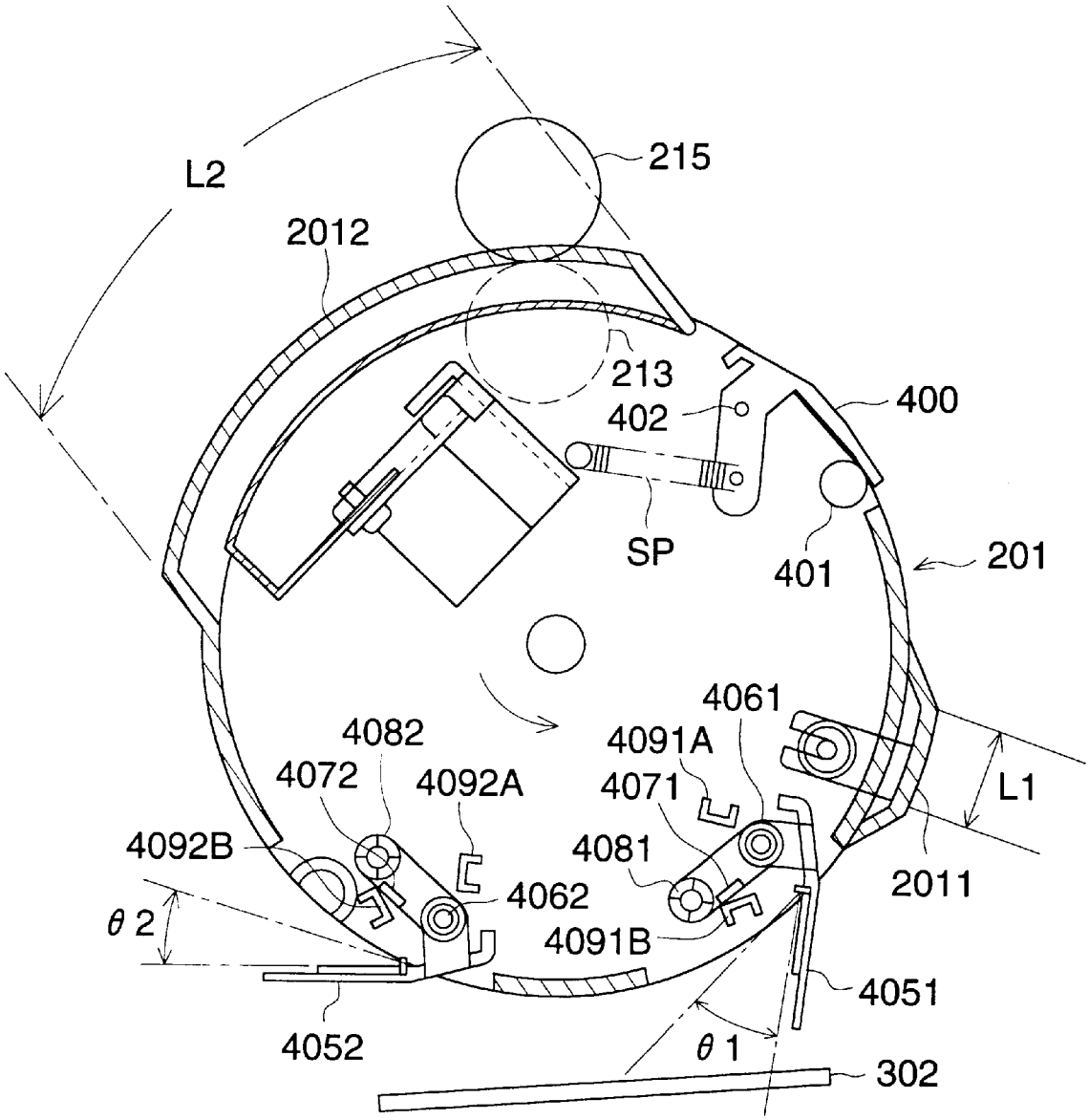
FIG. 15 is a sectional view of a reversing drum in the sheet finishing apparatus shown in FIG. 12.

Referring to FIG. 15, the structure of the reversing drum 201 will be detailed below.

A protruded portion 2011 having a guide surface which is higher than the peripheral surface of the drum (several mm higher than the peripheral surface of the drum), is formed at a position close to the movable holding member 400 on the upstream side of the movable holding member 400, in the rotational direction of the drum, and the almost same protruded portion 2012 is formed at a position apart from the movable holding member 400. The protruded portion 2011 suppresses floating of the leading edge portion of the sheet P in the vicinity of the stopping arm 204A, and prevents the leading edge of the sheet P from floating and bending due to impact at stopping, and being disordered, when travelling of the sheet P is blocked by the stopping arm 204A.

Figure 19:
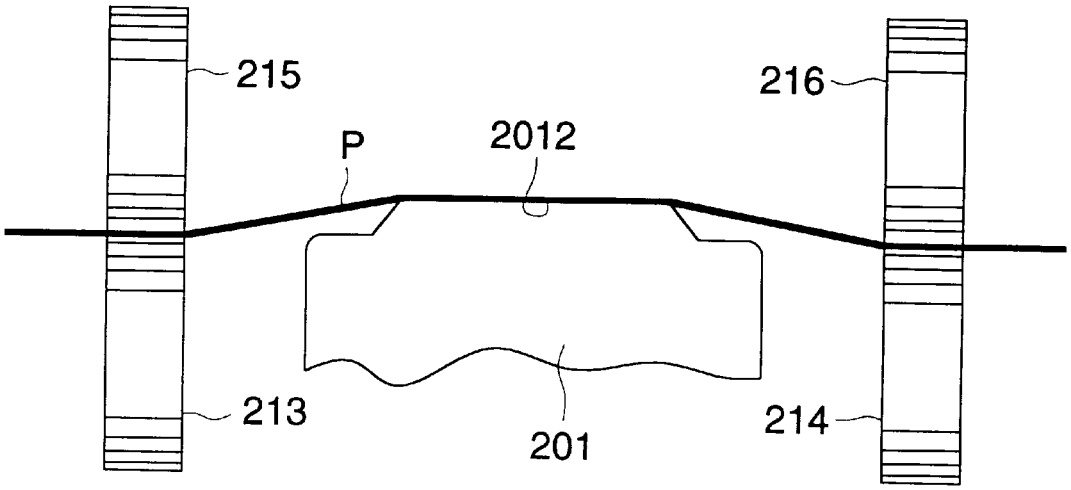
FIG. 19 is a view showing the sheet conveyance condition before reversing.

As shown in FIG. 19, the height of a portion supported by the reversing drum 201 is different from that of portions nipped by a pair of the conveying roller 215 and the driven roller 213 and a pair of the conveying roller 216 and the driven roller 214. Thereby, the protruded portion 2012 provides wave-like bending to the conveying sheet P so that the sheet P has stiffness, thereby, the protruded portion 2012 enhances the straight advancing property of the sheet P, so that the sheet P can be securely reversed. The protruded portion 2011 may only press the leading edge portion of the sheet P, and therefore, its length L1 in the rotational direction may be comparatively short. However, it is necessary for the protruded portion 2012 to securely reverse various sizes of sheets. Accordingly, the length L2 in its rotational direction is comparatively long. That is, preferably L1<L2.

Oscillation members 4051 and 4052, which are alignment means to align the sheet, are provided in the reversing drum 201. The oscillation member 4051 is rotatably provided on a shaft 4061, and has a portion protruded from the peripheral surface of the reversing drum 201. A weight 4081 is provided on the opposite side of the protruded portion. In the same manner, the oscillation member 4052 is rotatably provided on a shaft 4062, and a weight 4082 is provided on the opposite side of the protruded portion with the shaft 4062 between them. Numerals 4091A and 4091B are stoppers to limit the oscillation angle range of the oscillation member 4051, and numerals 4092A and 4092B are stoppers to limit the oscillation angle range of the oscillation member 4051.

The positional relationship of the oscillation member 4051 to the stopper 4091B and the positional relationship of the oscillation member 4052 to the stopper 4092B are set as follows. That is, as shown in FIG. 15, under the condition that the oscillation members 4051 and 4052 respectively contact with stoppers 4091B and 4092B, and the protruded portion is positioned in the extremely opened position, the stoppers 4091B and 4092B are formed in such a manner that angles θ1 and θ2, formed between the protruded portions of the oscillation members 4051,4052, and tangential lines on the peripheral surface of the reversing drum 201 at the protruded portions, have the relationship of θ1>θ2. When the stoppers 4091B and 4092B are formed as described above, the sheet P is regulated comparatively strongly by the oscillation member 4051 which initially acts upon the sheet P, the leading edge of the recording sheet comes into contact with the stopping arm 204A, and the regulation force of the oscillating member 4052 which acts succeedingly upon the sheet, is made comparatively weak. Thereby, the leading edge portion is not bent at the stopping arm 204A position, the leading edge of the sheet P is aligned, and the sheet P is stacked on the stacking table 302.

The oscillation members 4051 and 4052 operate as follows. In FIG. 15, when the oscillation members 4051 and 4052 stand at angular positions corresponding to 7 to 3 o'clock of the clock, both the weights 4081 and 4082 are positioned left with respect to shafts 4061 and 4062, provide moment to the oscillation members 4051 and 4052 so as to rotate the oscillation members 4051 and 4052 counterclockwise, the oscillation members 4051 and 5052 are respectively rotated counterclockwise, and contact portions 4071 and 4072 are in contact with the stoppers 4091B and 4092B, or in proximity to them.

According to the counterclockwise rotation of the reversing drum 201, the rotation moment generated by weights 4081 and 4082, is decreased, the oscillation members 4051 and 4052 are gradually closed, and rotated to the position at which these members form the surface, which coincides with the peripheral surface of the reversing drum. While oscillation members 4051 and 4052 are located at a position between about 11 and 6 o'clock of the clock, this condition, that is, the condition that the contact members 4071 and 4072 are in contact with stoppers 4091A and 4092A, and the oscillation members 4051 and 4052 are closed, is maintained. Corresponding to advancing of the rotation of the reversing drum, the oscillating members 4051 and 4052 are oscillated when weights 4081 and 4082 are moved from the right side of shafts 4061 and 4062 to the left side, and are quickly rotated counterclockwise, and protrude from the peripheral surface of the reversing drum 201. This protruding operation is carried out when the oscillation members 4051 and 4052 pass the position close to the stacking table 302, and the right end of sheet P contacts with the stopping arm 204A and is aligned while the sheet P is being pressed on the stacking table 302.

(Operation of the Sheet Finishing Apparatus)

Next, referring to FIG. 12 and FIGS. 16 to 19, operation of the above-described sheet finishing apparatus will be described below.

Figure 16:
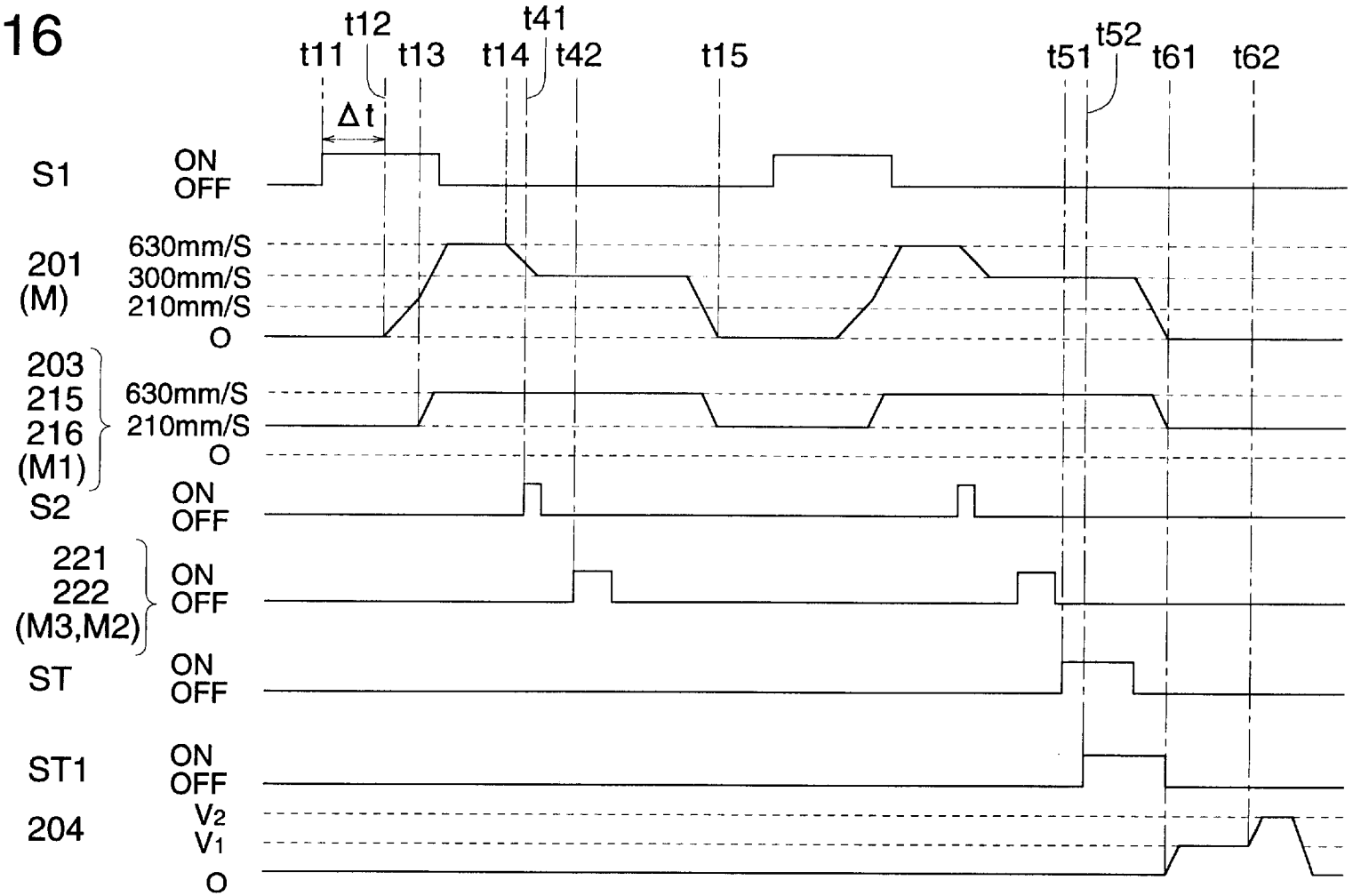
FIG. 16 is a time chart showing operations of the reversing drum, a conveying roller, etc., at the time of reverse conveyance of a small sized sheet.

FIG. 16 is a time chart showing time variations of the conveyance speed of the reversing drum 201 and that of the conveying rollers 203, 215, and 216 in the case of size A4 transverse feeding, size B5 transverse feeding, and conveyance of small sized sheet such as size A5 sheet. The motor M starts at time t12 delayed by a constant delay time Δt from a point of time t11 at which the sensor S1, provided at an entry of the sheet finishing apparatus 200, detects the leading edge of the sheet P, and the reversing drum 201 starts the rotation. At a point of time t13 when the conveyance speed of the reversing drum 201 reaches 210 mm/sec, it is further increased to 630 mm/sec, and maintained at constant speed. The delay time Δt is the time necessary for the leading edge of the sheet to reach from the sensor S2 to the apex of the reversing drum 201.

The initial conveyance speed 210 mm/sec of the reversing drum 201 is nearly equal to the conveyance speed in the image forming section 101, specifically, in the sheet delivery section. At a point of time t13, that is, when the conveyance speed of the reversing drum 201 reaches to the conveyance speed of 210 mm/sec nearly equal to the sheet conveyance speed in the image forming section 101, the movable holding member 400 of the reversing drum 201 receives the leading edge of the sheet P conveyed from the conveying roller 203. As described above, when the leading edge of the sheet is received, the conveyance speed of the reversing drum 201 is made nearly equal to the sheet conveyance speed in the image forming section 101, thereby, the leading edge portion of the sheet P is smoothly and securely held by the reversing drum 201. After the reversing drum 201 holds the leading edge portion of the sheet P, its conveyance speed is increased to 630 mm/sec at the point of time t13, as described above.

On the other hand, conveying rollers 203, 215, and 216 start rotation simultaneously with image formation in the image forming section 101, and are rotated at constant speed of 210 mm/sec which is the conveyance speed corresponding to the sheet conveyance speed in the image forming section 101. The conveyance speed of these rollers is increased to 630 mm/sec at the point of time t13 when the conveyance speed of the reversing drum 201 is increased from 210 mm/sec to 630 mm/sec, using the sheet leading edge detection signal of the sensor S1 as the reference.

Next, the conveyance speed of the reversing drum 201 is decreased from 630 mm/sec to 300 mm/sec at a point of time t14 at which the leading edge of the sheet P reaches the sheet stopping arm 204A.

After that, the reversing drum 201 stops at a point of time t15 at which a portion of the movable holding member, which is the sheet reading edge receiving section, is rotated to a home position. The conveying rollers 203, 215 and 216 continue to rotate at 630 mm/sec, their number of rotation is reduced to 210 mm/sec at the same point of time at which the reversing drum 201 stops, and the rotation is continued.

In the above operations, while the conveyance speed of the reversing drum 201 reaches from the start of rotation to the conveyance speed of 210 mm/sec, the movable holding member 400 reaches the apex position of the reversing drum 201 for receiving the leading edge portion of the sheet P. The home position of the movable holding member 400 is set to satisfy the above described conditions. Concretely, when the apex of the reversing drum 201 is defined to be 0°, the home position of the movable holding member 400 is a position of −10°.

The operation for increasing the speed of the reversing drum 201 and the conveying rollers 203, 215, 216 to 630 mm/sec, is carried out at a position at which the movable holding member 400 is rotated by 10° from the apex of the reversing drum 201.

The start and switching control of the conveyance speed of the reversing drum 201 and conveying rollers 203, 215, and 216, are carried out by time control by the timer, using the sheet leading edge detection control of the sensor S1 as the reference. In this connection, instead of the time control, a pulse motor may be used for the motor M to drive the reversing drum 201, and the driving motor M1 of the conveying rollers 215 and 216, and the control may be carried out according to the number of driving pulses of the motor, using the sheet leading edge detection signal of the sensor S1.

Figure 17:
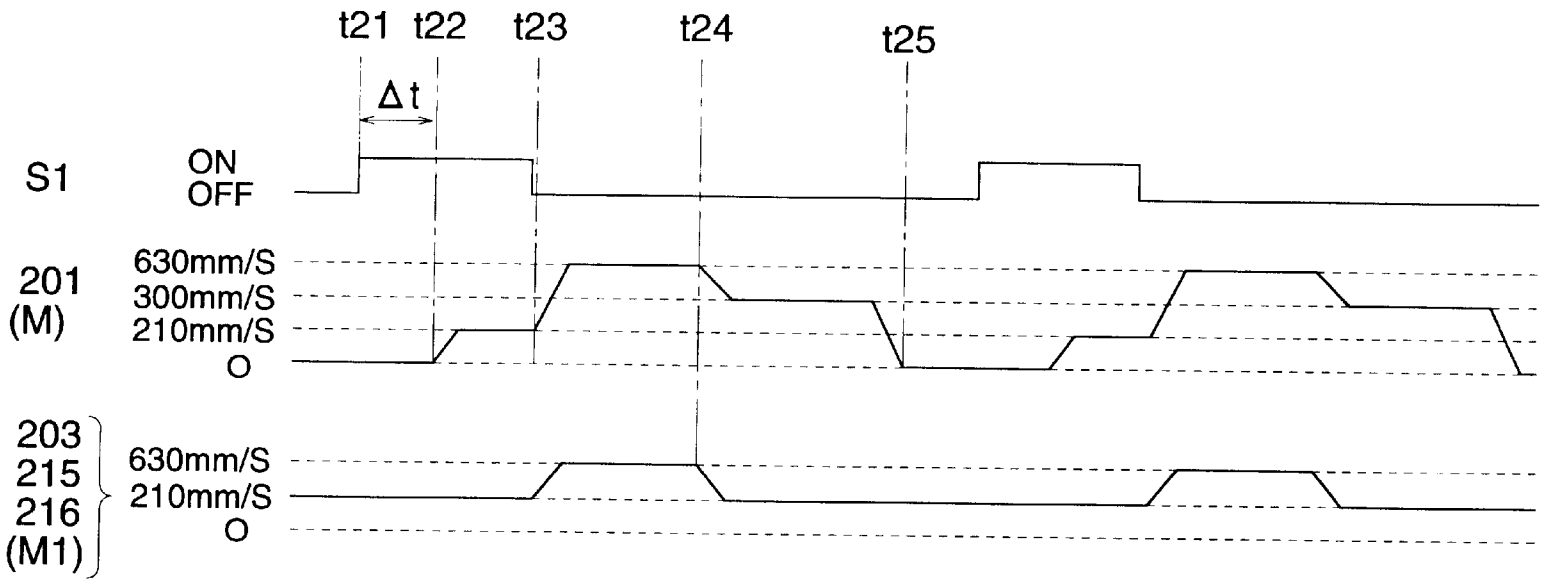
FIG. 17 is a time chart showing operations of the reversing drum and the conveying roller, at the time of reverse conveyance of a middle sized sheet.

FIG. 17 is a time chart showing a time variation of the conveyance speed of the reversing drum 201 and the conveyance speed of the conveying rollers 203, 215, and 216, in the case of the conveyance of the middle sized sheet such as size A4 sheet longitudinal feeding (A4R), or size B5 sheet longitudinal feeding (B5R). The reversing drum 201 starts at a point of time t22 which is delayed by a predetermined time Δt from a point of time t21 of detection of the leading edge of the sheet by the sensor S1, and is rotated at 210 mm/sec. In the same manner as in the above-described small sized sheet, the conveying rollers 203, 215, and 216 are rotated at 210 mm/sec. The reversing drum 201 receives the leading edge portion of the sheet P at a point of time at which its conveyance speed reaches 210 mm/sec, and holds the sheet. Next, according to the detection signal of the trailing edge of the sheet P by the sensor S1, the conveyance speed of the reversing drum 201 is increased to 630 mm/sec at a point of time t23. Simultaneously, the conveyance speed of the conveying rollers 203, 215, and 216 is also increased to 630 mm/sec. In this case, because the conveyance speed of the reversing drum 201 is increased after the sensor P detects the trailing edge of the sheet, the sheet P is separated from the image forming section 101, and does not interfere with the increase of the speed.

At a point of time t24 at which the leading edge of the sheet P reaches the position of the sheet stopping arm 204A, the conveyance speed of the reversing drum 201 is decreased to 300 mm/sec, and the reversing drum 201 is rotated. After that, the reversing drum 201 stops at t25.

On the other hand, the conveyance speed of the conveying rollers 203, 215, and 216 is decreased to 210 mm/sec, and the rotation is continued. In the same manner as in the small sized sheet, these start and switching control of the reversing drum 201, and the conveying rollers 203, 215, and 216 are carried out by the time control or pulse control, using the signal of the sensor S1 as the reference. The reason why initially the reversing drum 201 is rotated at low speed of 210 mm/sec, and then the speed is increased to 630 mm/sec, is as follows. At a point of time at which the leading edge of the sheet is received and held, the reliability of sheet P holding is securely obtained at low speed conveyance, and after that, by increasing the speed, the conveyance speed of the reversing drum 201 meets the sheet conveyance operation in the image forming section. That is, because the reversing drum 201 does not convey the sheet by the rotation from the stacking table 302 position to the home position, it conveys the sheet at the speed so much higher than that of the image forming section 101, and reversing processes the sheet continuously conveyed from the image forming section 101.

Figure 18:
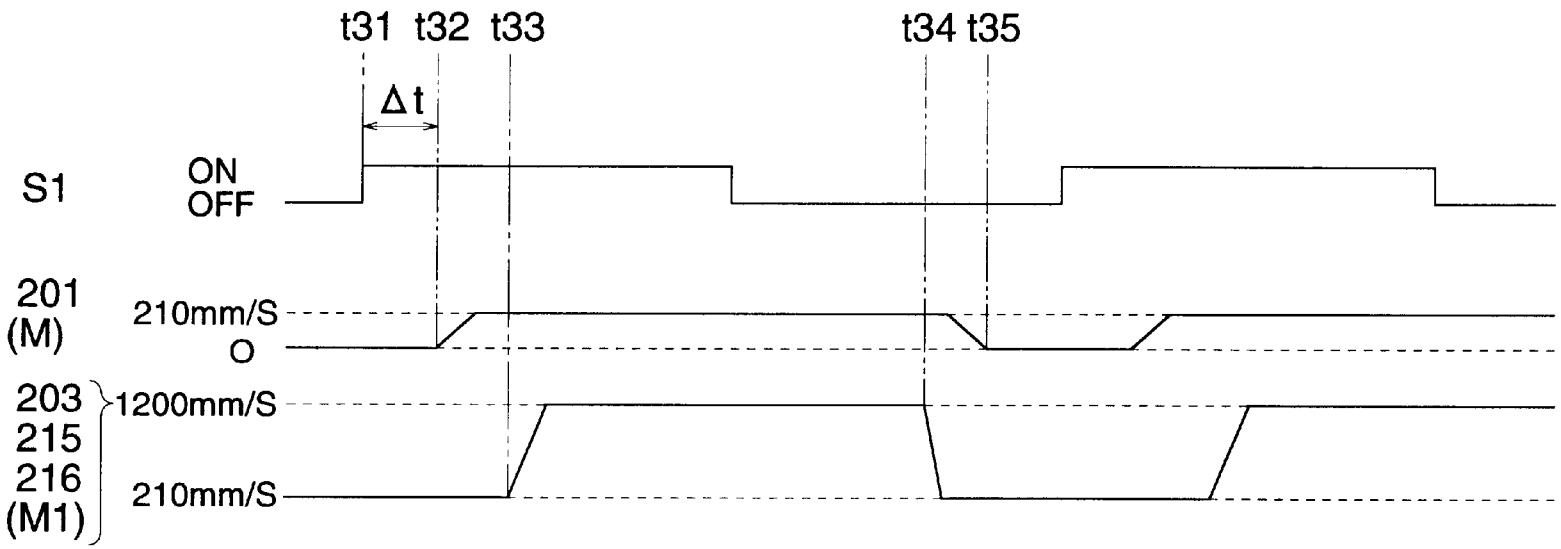
FIG. 18 is a time chart showing operations of the reversing drum and a conveying roller, at the time of reverse conveyance of a large sized sheet.

FIG. 18 is a time chart showing a time variation of the conveyance speed of the reversing drum 201 and the conveyance speed of the conveying rollers 203, 215, and 216, in the case of the conveyance of large sized sheet such as size A3 or size B4. The reversing drum 201 starts at a point of time t32 which is a predetermined time after from a point of time t31 of detection of the leading edge of the sheet by the sensor S1, and is rotated at 210 mm/sec. Next, at a point of time t33 at which the sensor S of the sheet delivery section in the image forming section 101 detects passage of trailing edge of the sheet, the rotation speed of the conveying rollers 203, 215, and 216 is increased to 1200 mm/sec. As described above, the conveying rollers 203, 215, and 216 convey the sheet P at 1200 mm/sec, while the reversing drum 201 conveys the sheet P at 210 mm/sec. As described above, when the trailing edge portion of the large sized sheet, which is difficult to be reversed, is conveyed at a higher speed than that of the leading edge portion of the sheet, the trailing edge portion of the sheet P is forcibly separated from the reversing drum 201, so that even a large sized sheet is securely reversed. In the case of the large sized sheet, sometimes the sheet P exists ranging from a position of the sheet stopping arm 204A to the image forming section 101. In this case, the control is carried out so that the speed is increased after the trailing edge of the sheet P is detected by the sensor S, provided in the sheet delivery section of the image forming section 101.

After sheet reversing, the conveyance speed of the conveying rollers 201,215, and 216 returns to 210 mm/sec, which is the normal conveyance speed, at a point of time t34, and the reversing drum 201 stops at a point of time t35.

When a point of time of switching control of the conveyance speed of the conveying means in the sheet finishing apparatus 200 is set according to the signal from the sensor S1 arranged in the sheet delivery section of the image forming section 101, the sheet conveyance path in the sheet finishing apparatus 200 can be shortened, so that overall size of the sheet finishing apparatus can be reduced.

Referring to FIG. 16, aligning and stapling of the sheet P will be described below.

A sensor S2 is provided such that it detects the sheet passing through a position at which the sheet leading edge portion receiving portion of the reversing drum 201 is rotated by a predetermined angle, for example, by 155° from its apex. According to a signal from the sensor S2 at a point of time t41, position regulating members 221, and 222 are operated at a point of time t42, move by a distance corresponding to a sheet size, and align the sheet P. Reversing conveyance and alignment operations of the sheet P are carried out predetermined times, and a predetermined number of sheets P are collected on the stacking table 302. After the signal of the completion of the alignment operation in the width direction of the conveyance path is received, the staplers ST and ST1 are operated at points of time t51, and t52, and staple the sheets P. Two staplers ST and ST1 are not simultaneously operated, but are operated with time difference. At a point of time t61 at which a signal of completion of the operation of the staplers ST and ST1 is received, a motor to drive the sheet delivery member 204 is operated, and delivers the sheets P onto the reversed sheet delivery tray 206. The sheet delivery member 204 is reciprocated by a motor as described above, the speed of the motor is increased at t62, and the motor reciprocates the sheet delivery member 204 at a high speed.

According to the present invention, the reversing means receives the leading edge portion of the sheet at low speed rotation, and then, by increasing the conveyance speed of the reversing means, secured reverse conveying of the sheet, and reverse conveying, meeting the image forming section, can be carried out.

According to the present invention, the sheets reversed by the reversing means are aligned and accumulated on the stacking means.

According to the present invention, the sheet is securely reversed and conveyed onto stacking means.

What is claimed is:

1. A sheet finishing apparatus for receiving a sheet on which an image has been formed by an image forming apparatus, and for ejecting the sheet after a front side thereof is reversed, the sheet finishing apparatus comprising:

(a) a sheet conveying means for conveying the sheet received from the image forming apparatus in a downstream direction;

(b) a sheet reversing means for receiving the sheet conveyed by the sheet conveying means, and for reversing the front side of the sheet by rotation;

(c) a sheet holding means provided on a peripheral portion of the sheet reversing means for holding a leading edge portion of the sheet conveyed by the sheet conveying means, said sheet holding means being capable of being opened or closed; and (d) a control means which causes a linear speed on a sheet conveyance surface of the sheet conveying means to be increased so as to increase a difference in conveyance speed between the sheet conveying means and the sheet reversing means, after the sheet is held by the sheet holding means on the sheet reversing means.

2. The sheet finishing apparatus of claim 1, wherein after the sheet is held by the sheet holding means on the sheet reversing means, the control means controls the sheet reversing means to start rotation, and when a conveyance angle of the sheet reversing means reaches a first rotation angle, the control means controls the sheet conveying means and the sheet reversing means to increase conveyance linear speeds thereof, and further when the conveyance angle of the sheet reversing means reaches a second rotation angle, the control

3. The sheet finishing apparatus of claim 2 further comprising a sheet stopping means for blocking the leading edge portion of the sheet to stop at a position where the front side of the sheet is reversed by a rotation of the sheet reversing means, wherein the sheet reversing means further comprises a movement member for aligning a leading edge of the sheet by further rotation of the sheet reversing means after the sheet reversing means causes the sheet to be collided with the sheet stopping means while only the conveyance linear speed of the sheet reversing means is maintained at the reduced speed.

4. The sheet finishing apparatus of claim 1, further comprising:

a sheet stopping means for blocking the leading edge portion of the sheet to be stopped at a position where the front side of the sheet is reversed by rotating the sheet reversing means; and a sheet stacking means for stacking the sheet separated from the sheet reversing means by a further rotation of the sheet reversing means after the leading edge portion of the sheet is blocked by the sheet stopping means.

5. The sheeting finishing apparatus of claim 1, further comprising a sheet finishing means provided on the sheet stacking means for stapling sheets stacked on the sheet stacking means.

6. The sheeting finishing apparatus of claim 1, further comprising an aligning means provided on the sheet reversing means for pushing the leading edge portion of the sheet toward the sheet stopping means to collide with the sheet stopping means for alignment.

7. The sheet finishing apparatus of claim 6, wherein the aligning means includes a first aligning means provided upstream of and adjacent to the sheet reversing means in a rotation direction of a receiving position of the sheet reversing means where the sheet reversing means receives the leading edge portion of the sheet, and a second aligning means provided further upstream of the first aligning means.

8. The sheet finishing apparatus of claim 7, wherein the aligning means includes an operating member movable between a position at which the aligning means is protruded from a sheet conveyance surface of the sheet reversing means and a position at which the aligning means is not protruded from the sheet conveyance surface of the sheet reversing means.

9. The sheet finishing apparatus of claim 8, wherein the first and second aligning means satisfy the following expression:

$$\theta 1 > \theta 2$$

wherein θ1 represents an angle between the operating member of the first aligning means and a tangential line of the sheet conveyance surface of the sheet reversing means when the operating member is positioned at a most protruded position, and θ2 represents an angle between the operating member of the second aligning means and a tangential line of the sheet conveyance surface of the sheet reversing means when the operating member is positioned at a most protruded position.

10. The sheet finishing apparatus of claim 9, wherein the aligning means is rotatably supported around a shaft provided on the sheet reversing means and includes a weight by which the aligning means oscillated around the shaft.

11. The sheet finishing apparatus of claim 6 further comprising a position regulating means provided on the sheet stacking means for regulating a position of the sheet in a direction perpendicular to a sheet conveying direction.

12. The sheet finishing apparatus of claim 6, wherein the sheet stopping means moves to push a leading edge of the sheet placed on the sheet stacking means so as to eject the sheet from the sheet stacking means.

13. The sheet finishing apparatus of claim 6, wherein the sheet reversing means comprises a drum for conveying the sheet by a rotation of the drum.

14. The sheet finishing apparatus of claim 6, wherein the sheet reversing means is provided on a part in a width direction of a sheet conveyance path, and the sheet finishing apparatus further comprises a sheet guiding means provided on the other part where the sheet reversing means is absent in the width direction of the sheet conveyance path for guiding the sheet, wherein the sheet guiding means includes a guiding surface having substantially the same shape as that of a sheet conveyance surface of the sheet reversing means.

15. The sheet finishing apparatus of claim 6 further comprising a sheet finishing means for finishing the sheet.

16. The sheet finishing apparatus of claim 1 further comprising a protrusion provided on a circumferential surface of the sheet reversing means for suppressing a floating of the sheet placed on the sheet stacking means.

17. The sheet finishing apparatus of claim 16, wherein a conveyance roller having a first sheet conveyance surface is provided on the sheet conveying means adjacent to the sheet reversing means, and a protruded guiding surface representing a second sheet conveyance surface which has a height different from the first conveyance surface is provided on the sheet reversing means so that a straight advance property of the sheet can be enhanced.

18. The sheet finishing apparatus of claim 17, wherein the sheet reversing means includes the protrusion and the protruded guiding surface satisfying the following expression:

$$L1<L2$$

wherein L1 represents a length of the protrusion in a rotation direction of the sheet reversing means and L2 represents a length of the protruded guiding member in the direction of the sheet reversing means.

19. The sheet finishing apparatus of claim 16 further comprising a position regulating means provided on the sheet stacking means for regulating a position of the sheet in a direction perpendicular to a sheet conveying direction.

20. The sheet finishing apparatus of claim 16, wherein the sheet stopping means moves to push a leading edge of the sheet placed on the sheet stacking means so as to eject the sheet from the sheet stacking means.

21. The sheet finishing apparatus of claim 16, wherein the sheet reversing means comprises a drum for conveying the sheet by a rotation of the drum.

22. The sheet finishing apparatus of claim 16, wherein the sheet reversing means is provided on a part in a width direction of a sheet conveyance path, and the sheet finishing apparatus further comprises a sheet guiding means provided on another part where the sheet reversing means is absent in the width direction of the sheet conveyance path for guiding the sheet, wherein the sheet guiding means includes a guiding surface having substantially a same shape as that of a sheet conveyance surface of the sheet reversing means.

23. The sheet finishing apparatus of claim 16 further comprising a sheet finishing means for finishing the sheet.

24. The sheet finishing apparatus of claim 11, wherein a conveyance roller having a first sheet conveyance surface is provided on the sheet conveying means adjacent to the sheet reversing means, and a protruded guiding surface representing a second sheet conveyance surface which has a height different from the first conveyance surface is provided on the sheet reversing means so that a straight advance property of the sheet can be enhanced.

25. The sheet finishing apparatus of claim 24 further comprising a position regulating means provided on the sheet stacking means for regulating a position of the sheet in a direction perpendicular to a sheet conveying direction.

26. The sheet finishing apparatus of claim 24, wherein the sheet stopping means moves to push a leading edge of the sheet placed on the sheet stacking means so as to eject the sheet from the sheet stacking means.

27. The sheet finishing apparatus of claim 24, wherein the sheet reversing means comprises a drum for conveying the sheet by a rotation of the drum.

28. The sheet finishing apparatus of claim 24, wherein the sheet reversing means is provided on a part in a width direction of a sheet conveyance path, and the sheet finishing apparatus further comprises a sheet guiding means provided on another part where the sheet reversing means is absent in the width direction of the sheet conveyance path for guiding the sheet, wherein the sheet guiding means includes a guiding surface having substantially a same shape as that of a sheet conveyance surface of the sheet reversing means.

29. The sheet finishing apparatus of claim 24 further comprising a sheet finishing means for finishing the sheet. means controls only the sheet reversing means to reduce the conveyance linear speed thereof.

30. The sheet finishing apparatus of claim 1, wherein the sheet holding means comprises a stationary holding member fixed on the sheet reversing means and a movable holding member being opened or closed by a cam according to the rotation of the sheet reversing means.

31. The sheet finishing apparatus of claim 30, wherein the sheet holding means further comprises a resilient member for urging the movable holding member toward the stationary holding member to hold the sheet between the movable and stationary holding members.

32. The sheet finishing apparatus of claim 1, wherein the sheet conveying means comprises sheet conveyance members provided above and on both outer sides adjacent to the sheet reversing means, and sheet guiding members provided on the both outer sides and along a rotation direction of a peripheral portion of the sheet reversing means.

33. The sheet finishing apparatus of claim 1, further comprising a driving means for rotating the sheet reversing means at a predetermined first conveyance speed at a time when the sheet reversing means receives the sheet conveyed by the sheet conveying means, and thereafter for rotating the sheet reversing means at a predetermined second conveyance speed higher than the predetermined first conveyance speed.

34. The sheet finishing apparatus of claim 33, wherein the driving means comprises means for driving the sheet conveying means to operate substantially at a same conveyance speed as the first conveyance speed when the sheet reversing means receives the leading edge portion of the sheet, and for then driving the sheet conveying means to operate at an increased speed.

35. The sheet finishing apparatus of claim 34, wherein the means for driving the sheet conveying means comprises a pulse motor.

36. The sheet finishing apparatus of claim 34, wherein the conveyance speed of the sheet conveying means is increased according to a detecting signal sent from a sheet sensor provided in a sheet receiving portion of the sheet finishing apparatus.

37. The sheet finishing apparatus of claim 33, wherein the driving means comprises a pulse motor.

38. The sheet finishing apparatus of claim 37, wherein the conveyance speed of the sheet reversing means is changed according a counting value of a number of pulses of a driving pulse of the pulse motor.

39. The sheet finishing apparatus of claim 33, wherein the sheet conveyance speed of the sheet reversing means from the first to second conveyance speed is switched over according to a detecting signal sent from a sheet sensor provided in a sheet receiving portion of the sheet finishing apparatus.

40. The sheet finishing apparatus of claim 33 further comprising a sheet finishing means for finishing the sheet.

41. The sheet finishing apparatus of claim 40, wherein the sheet finishing means is operated according to a signal sent from a sensor for detecting that the sheet reversing means reaches a predetermined angular position.

42. The sheet finishing apparatus of claim 41, wherein the sheet finishing means comprises a stapler for stapling a plurality of sheets.

43. The sheet finishing apparatus of claim 41, wherein the sheet finishing means comprises a punch for punching the sheet.

44. The sheeting finishing apparatus of claim 33, wherein said control means comprises means for driving the sheet conveying means and the sheet reversing means substantially at a same first conveyance speed to convey the leading edge portion of the sheet, and then for driving the sheet conveying means at a second conveyance speed higher than the first conveyance speed, and for driving the sheet reversing means at the first conveyance speed, to thereby convey a trailing portion of the sheet due to the difference in conveyance speed between the sheet reversing means and the sheet conveying means so that the sheet is separated from the sheet reversing means when the sheet is reversed.

45. The sheet finishing apparatus of claim 44 further comprising a position regulating means provided on the sheet stacking means for regulating a position of the sheet in a direction perpendicular to a sheet conveying direction.

46. The sheet finishing apparatus of claim 44, wherein the sheet stopping means moves to push a leading edge of the sheet placed on the sheet stacking means so as to eject the sheet from the sheet stacking means.

47. The sheet finishing apparatus of claim 44, wherein the sheet reversing means comprises a drum for conveying the sheet by a rotation of the drum.

48. The sheet finishing apparatus of claim 44, wherein the sheet reversing means is provided on a part in a width direction of a sheet conveyance path, and the sheet finishing apparatus further comprises a sheet guiding means provided on another part where the sheet reversing means is absent in the width direction of the sheet conveyance path for guiding the sheet, wherein the sheet guiding means includes a guiding surface having substantially a same shape as that of a sheet conveyance surface of the sheet reversing means.

49. The sheet finishing apparatus of claim 44 further comprising a sheet stapling means for stapling a plurality of sheets.

50. The sheet finishing apparatus of claim 44, wherein the conveyance speed of the sheet conveying means is changed according to a detecting signal sent from a sensor provided on a sheet delivering portion of an image forming section.

51. The sheet finishing apparatus of claim 33, wherein an angular position of the sheet reversing means at which a conveyance speed of the sheet is increased according to a size of the sheet, is changed.

52. The sheet finishing apparatus of claim 1, wherein the control means comprises means for controlling the sheet conveying means to operate substantially at a same conveyance speed as that of the sheet reversing means when the sheet holding means hold the leading edge portion of the sheet.

53. The sheet finishing apparatus of claim 1, wherein the control means comprises means for changing the conveyance speed of the sheet reversing means according to a size of the sheet conveyed after the sheet holding means holds the leading edge portion of the sheet.

* * * * *